US005140372A

United States Patent [19]

Nakamura

[11] Patent Number: 5,140,372

[45] Date of Patent: Aug. 18, 1992

[54] IMAGE FORMING APPARATUS HAVING A PLURALITY OF DEVELOPING UNITS AND DETECTORS FOR DETECTING TONER DENSITY IN THE DEVELOPING UNITS

[75] Inventor: Minoru Nakamura, Toyohashi, Japan

[73] Assignee: Minolta Camera Kabushiki Kaisha, Osaka, Japan

[21] Appl. No.: 641,259

[22] Filed: Jan. 15, 1991

[30] Foreign Application Priority Data

Jan. 17, 1990 [JP] Japan ..... 2-9125

[51] Int. Cl.[5] ..... G03G 21/00

[52] U.S. Cl. ..... 355/246; 355/208; 355/326

[58] Field of Search ..... 355/246, 209, 208, 207, 355/326, 327; 118/689, 688, 691

[56] References Cited

U.S. PATENT DOCUMENTS 4,542,985 9/1985 Honma et al. ..... 355/208 X
4,952,987 8/1990 Takano .
4,963,927 10/1990 Ishihara ..... 355/326 X

FOREIGN PATENT DOCUMENTS 58-198067 11/1983 Japan ..... 355/208
59-26763 2/1984 Japan ..... 355/208
59-281040 7/1986 Japan ..... 355/208
61-230175 10/1986 Japan ..... 355/208
62-35382 2/1987 Japan ..... 355/208
62-189484 8/1987 Japan ..... 355/208
62-289869 12/1987 Japan ..... 355/208

*Primary Examiner*—R. L. Moses
*Assistant Examiner*—Shuk Y. Lee
*Attorney, Agent, or Firm*—Burns, Doane, Swecker & Mathis

[57] ABSTRACT

An image forming apparatus comprising first and second developing units each of which has detector for detecting toner density in the developing unit, input member for inputting toner replenishment instructions to each of the first and second developing units, and first and second replenishing members provided respectively to the first and second developing units for replenishing the toner in response to the input of the toner replenishment instructions by an operator. One of the first and second developing units is selected by the operator upon the copying. In this image forming apparatus, the replenishing members replenish the toner to the first and second developing units having toner densities of less than a predetermined value irrespective of the selection of the developing units.

12 Claims, 27 Drawing Sheets

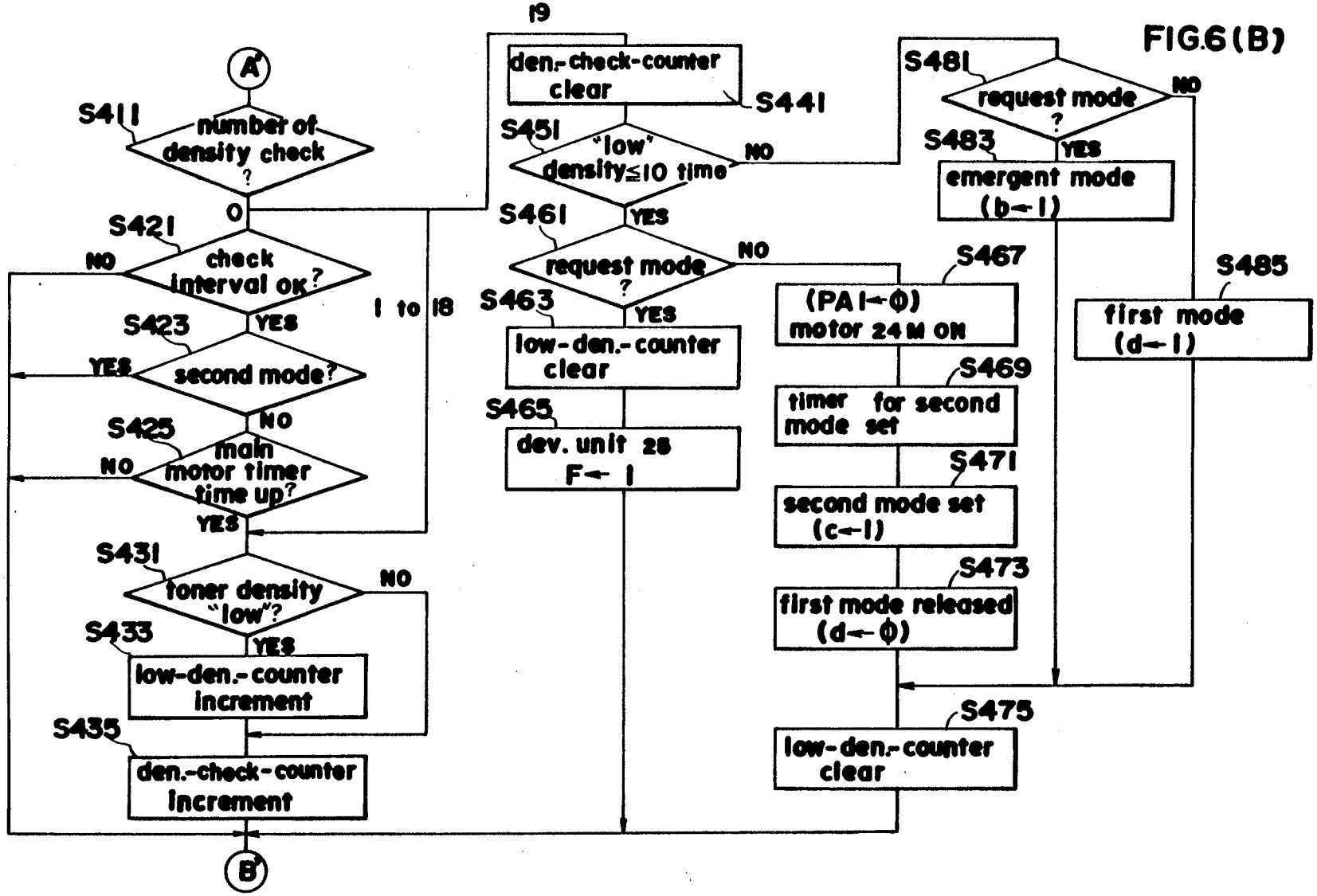
FIG.6(B)
A
number of density check ?
S411
0
check interval ok?
S421
NO
YES
1 to 18
second mode?
S423
YES
NO
main motor timer time up?
S425
NO
YES
toner density "low"?
S431
NO
YES
low-den.-counter increment
S433
den.-check-counter increment
S435
B
19
den.-check-counter clear
S441
"low" density≤10 time
S451
NO
YES
request mode ?
S461
NO
YES
low-den.-counter clear
S463
dev. unit 25 F←1
S465
request mode ?
S481
NO
YES
emergent mode (b←1)
S483
first mode (d←1)
S485
(PA1←φ) motor 24M ON
S467
timer for second mode set
S469
second mode set (c←1)
S471
first mode released (d←φ)
S473
low-den.-counter clear
S475

IMAGE FORMING APPARATUS HAVING A PLURALITY OF DEVELOPING UNITS AND DETECTORS FOR DETECTING TONER DENSITY IN THE DEVELOPING UNITS

BACKGROUND OF THE INVENTION

1. FIELD OF THE INVENTION

The present invention relates to an image forming apparatus having a plurality of developing devices.

2. DESCRIPTION OF THE RELATED ART

Copying machines having a plurality of developing devices containing toners of different colors have become common in recent years. Toner replenishment in the aforesaid copying machines is accomplished by two kinds of toner replenishment, to wit, routine toner replenishment and non-routine emergency toner replenishment. Routine toner replenishment, for example, indicates toner replacement wherein a specified quantity of toner is replenished at a specified timing to replace an estimated quantity of consumed toner used in the normal operation of the copying machine, to wit, so as to replace a specified quantity of toner consumed by the developing operation or replace a specified quantity of toner consumed by toner dust dispersion and the like which is unrelated to the developing operation.

In contrast, non-routine emergency toner replenishment indicates toner replenishment to prevent a reduction of toner density when a condition arises wherein toner consumption is greater than that during normal copying machine operation. The aforesaid emergency toner replenishment is accomplished by having the operator actuate an input means for inputting a toner replenishment instruction.

For example, when an original document having a dark image density is copied repeatedly, the quantity of consumed toner is greater than the quantity of toner estimated for normal consumption, such that the previously described routine toner replenishment is not equivalent to current toner consumption. Thus, a non-routine toner replenishment is accomplished by the previously mentioned input means so as to avoid a reduction of copy image quality.

The aforesaid non-routine toner replenishment in the previously described copying machine is conventionally executed only for the selected developing device.

For example, when a developing device accommodating black toner is selected and the previously mentioned input means is actuated by the copying machine operator, non-routine toner replenishment is executed only for the developing device accommodating black toner.

Accordingly, when non-routine toner replenishment is desired for a developing device which has not been selected, said developing device must be selected by a specified operation and thereafter the aforesaid input means must be operated.

In the emergency toner replenishment operation for individual developing devices, the waiting time until emergency toner replenishment is directed for the next developing device is unreasonable because mixing of the developing material and the like requires a long time.

That is, in a copying machine having a plurality of developing devices, a long time is required to accomplish non-routine toner replenishment and the number of steps in the operation is quite complex.

Further, when the aforesaid copying machine is capable of producing color images by mixing three primary colors of red, green and blue, and non-routine toner replenishment is executed only for the developing device selected by the operation of the previously mentioned input means, differences accrue in the quantities of toner accommodated in each of the various developing devices leading to unsatisfactory color matching in the copy images.

SUMMARY OF THE INVENTION

A main object of the present invention is to provide an image forming apparatus having a plurality of developing devices and which is capable of normally forming images having suitable toner density.

A further object of the present invention is to provide an image forming apparatus having a plurality of developing devices and which is capable of simply and rapidly replenishing toner accommodated within a developing device.

A still further object of the present invention is to provide an image forming apparatus having a plurality of developing devices and which is capable of accomplishing emergency toner replenishment when toner is consumed at a rate which exceeds the normal level of toner consumption not only for a developing device selected through an input operation by the copying machine operator but also for non-selected developing devices.

These and other objects of the present invention are accomplished by providing an image forming apparatus for developing with toner electrostatic latent images formed on a photoconductive member, said image forming apparatus comprising:

a plurality of developing means;

detecting means provided to each developing means for detecting toner density in the developing means;

selecting means for selecting at least one developing means from the plurality of the developing means for development;

input means for inputting toner replenishment instructions to each developing means;

replenishing means provided to each developing means for replenishing a toner within the developing means wherein toner desities are less than a predetermined value in either a normal mode or a special mode, the replenishing means replenishing the toner during the copying operation in the normal mode and replenishing the toner in response to the input of the toner replenishment instructions in the special mode; and control means for controlling the replenishing means so as to replenish the toner to the selected developing means upon the toner replenishment in the normal mode and to replenish the toner not only to the selected developing means but also to the non-selected developing means upon the toner replenishment in the special mode.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

FIG. 1 is a model view showing the configuration in the vicinity of the multiple developing devices;

FIG. 2 is a construction view showing the control circuit of the copying machine;

FIG. 3 is a flow chart showing the main control routine for the copying machine;

FIG. 4 is a flow chart showing the subroutine for input process shown in FIG. 3;

FIGS. 5A through 5D are flow charts showing the subroutines of the black toner replenishment shown in FIG. 3;

FIGS 6A through 6D are flow charts showing the subroutines of the color toner replenishment shown in FIG. 3.

FIG. 14 is a brief section view of a full color copying machine related to the second embodiment;

FIG. 15 is a section view briefly showing the construction of developing devices 120 through 150 of the full color copying machine;

FIG. 16 is an illustration showing the developing devices and toner replenishment devices, and the toner replenishment tubes connecting the toner resupply device with the developing device in the full color copying machine;

FIG. 17 is an illustration showing the construction o control circuit of the full color copying machine;

FIG. 18 is a flow chart showing the main control routine of the full color copying machine;

FIG. 19 is a flow chart showing the subroutine of the input process shown in FIG. 18;

FIG. 20 is a time chart illustrating operation by the control in the second embodiment;

DETAILED DESCRIPTION OF THE PREFERRED EMBODIMENTS

A first embodiment of the present invention is described hereinafter.

The device of the first embodiment is an electrophotographic copying machine which scans an original document image disposed on a document platen and the light image reflected therefrom forms an image on the surface of a photoconductive drum thereby forming an electrostatic latent image thereon, said electrostatic latent image is then developed into a toner image by first and/or second developing device(s), and thereafter said toner image is transferred to a recording sheet.

(I) CONSTRUCTION NEAR DEVELOPING DEVICES

Figure 1:
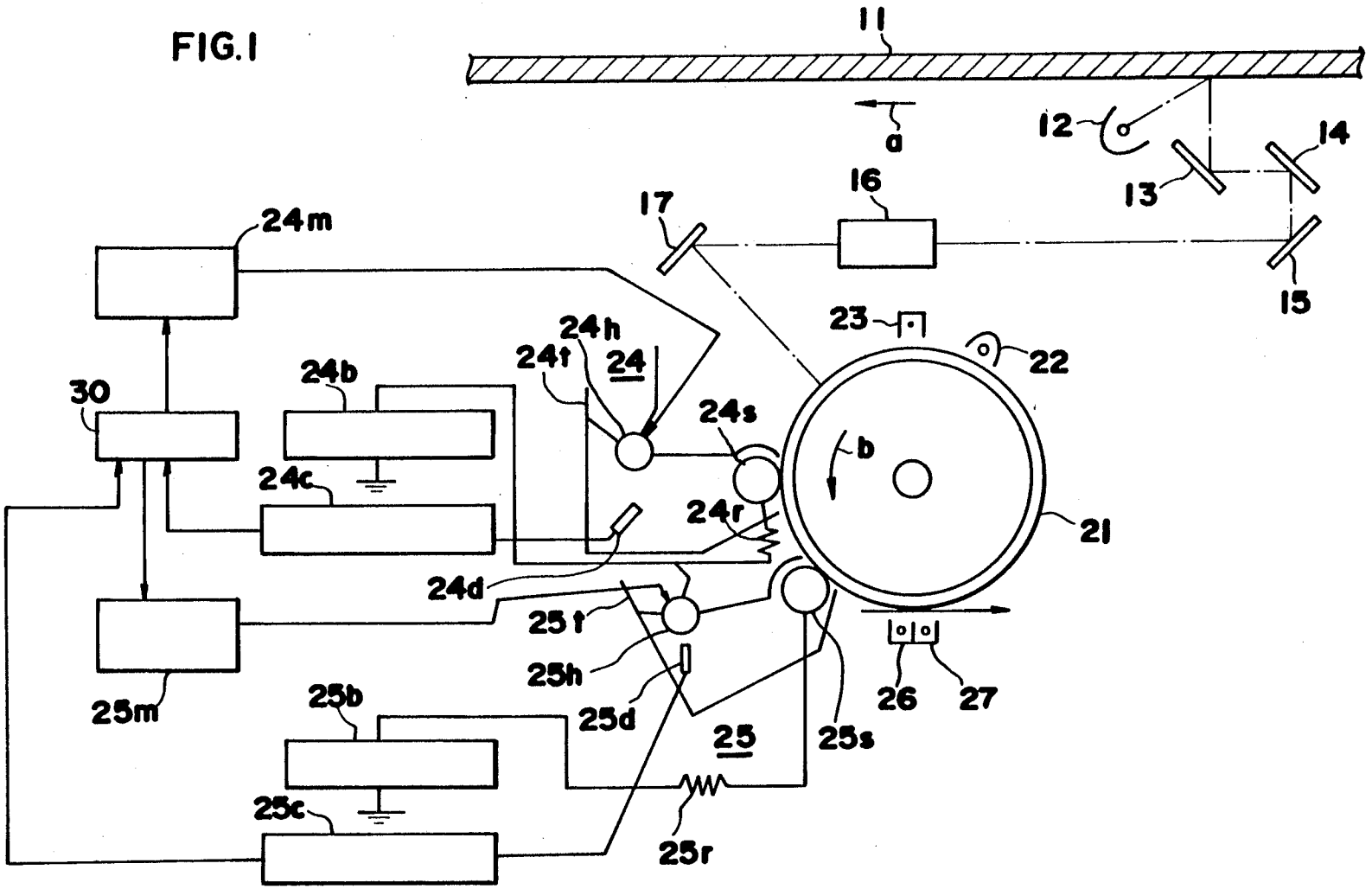
FIGS. 1 through 6 are illustrations relating to a first embodiment of the invention.

The copying machine image forming apparatus of the first embodiment of the invention is described hereinafter with reference to FIG. 1. The sheet supply device for supplying the recording sheets and the image fixing device are excluded from the following description because they are not directly connected with the essence of the present invention.

i. Optical Scanning System

The image reflection light from the original document disposed on original document platen 11 passes through an optical path indicated by the dashed line in the drawing by means of an optical scanning system which scans of said original document through light exposure, and said image reflection light is projected on the surface of photoconductive drum 21.

The aforesaid optical scanning system comprises an exposure lamp 12, reflecting mirrors 13, 14 and 15, lens 16 and reflecting mirror 17 and the like disposed below the aforesaid original document platen 11.

Exposure lamp 12 and reflecting mirror 13 are installed on a first scanning member, not shown in the drawing, which travels in the arrow [a] direction during the exposure scan. Reflecting mirrors 14 and 15 are installed on a second scanning member, not shown in the drawing, which travels in the arrow[a] direction at ½ the travel speed of the first scanning member. The travel speeds of the first and second scanning members are set relative to the copy magnification so as to have a specified correspondence to the rotational speed of photoconductive drum 21.

ii. Photoconductive Drum Rotation

Photoconductive drum 21 is provided so as to be rotatable at constant speed in the arrow [b] direction. Around the periphery of photoconductive drum 21 are provided an eraser lamp 22 for removing residual electric charge from the surface of photoconductive drum 21, a charger 23 for uniformly charging the surface of photoconductive drum 21, a first developing device 24 and second developing device 25 for developing an electrostatic latent image formed on the surface of photoconductive drum 21, a transfer charger 26 for transferring the developed toner image formed on the surface of photoconductive drum 21 to the surface of a recording sheet supplied thereto by means of a paper supply mechanism not shown in the drawing, and a separation charger 27 for peeling from the surface of photoconductive drum 21 the recording sheet bearing the transferred toner image thereon.

The surface of photoconductive drum 21 is uniformly charged by charger 23. Thereafter, an electrostatic latent image is formed on the uniformly charged surface of photoconductive drum 21 by means of the previously mentioned image reflection light. The electrostatic latent image is developed as a toner image by first developing device 24 and second developing device 25, and said toner image is transferred to the surface of a recording sheet by transfer charger 26.

iii. Developing Devices

First and second developing devices 24 and 25 for developing the electrostatic latent image formed on photoconductive drum 21 are developing devices using two-component developing materials comprising a toner and a carrier. A color toner is accommodated in first developing device 24, and a black toner is accommodated in second developing device 25.

First and second developing devices 24 and 25 are provided developing sleeve 24*s* and 25*s*, respectively, which are provided so as to maintain a specified spacing relative to the exterior surface of photoconductive drum 21. Developing sleeves 24*s* and 25*s* have developing bias voltages applied thereto from bias power sources 24*b* and 25*b* through bias resistors 24*r* and 25*r*, respectively.

Further, toner tanks 24*t* and 25*t* are provided above first and second developing devices 24 and 25, respectively. Toner replenishment from toner tanks 24*t* and 25*t* to developing devices 24 and 25, respectively, is accomplished by rotating toner replenishment rollers 24*h* and 25*h* provided at the base of each toner tank 24*t* and 25*t*. That is, the peripheral surface of each toner replenishment roller 24*h* and 25*h* is constructed so as to have notched portions formed therein, such that the toner accommodated in each toner tank 24*t* and 25*t* is continuously supplied in set quantity to developing devices 24 and 25 by means of the rotation of toner replenishment rollers 24*h* and 25*h* through the aforesaid notched portions formed thereon.

Toner density sensors 24*d* and 25*d* are provided at specified positions in developing devices 24 and 25, respectively, to detect the magnetic permeability of two-component developing materials comprising a toner and a magnetic carrier. The magnetic permeabilities detected by toner density sensors 24*d* and 25*d* is transmitted to control circuit 30 after the electrical signals are converted by toner density detection circuits 24*c* and 25*c*, respectively.

Control circuit 30 is the circuit that controls toner replenishment and the like, and output a drive signals to drive circuits 24*m* and 25*m* of replenishment rollers 24*h* and 25*h* to control the amount of toner replenished to developing devices 24 and 25. There are three toner replenishment modes, the details of which are discussed later.

(II) CONTROL CIRCUIT CONSTRUCTION

Figure 2:
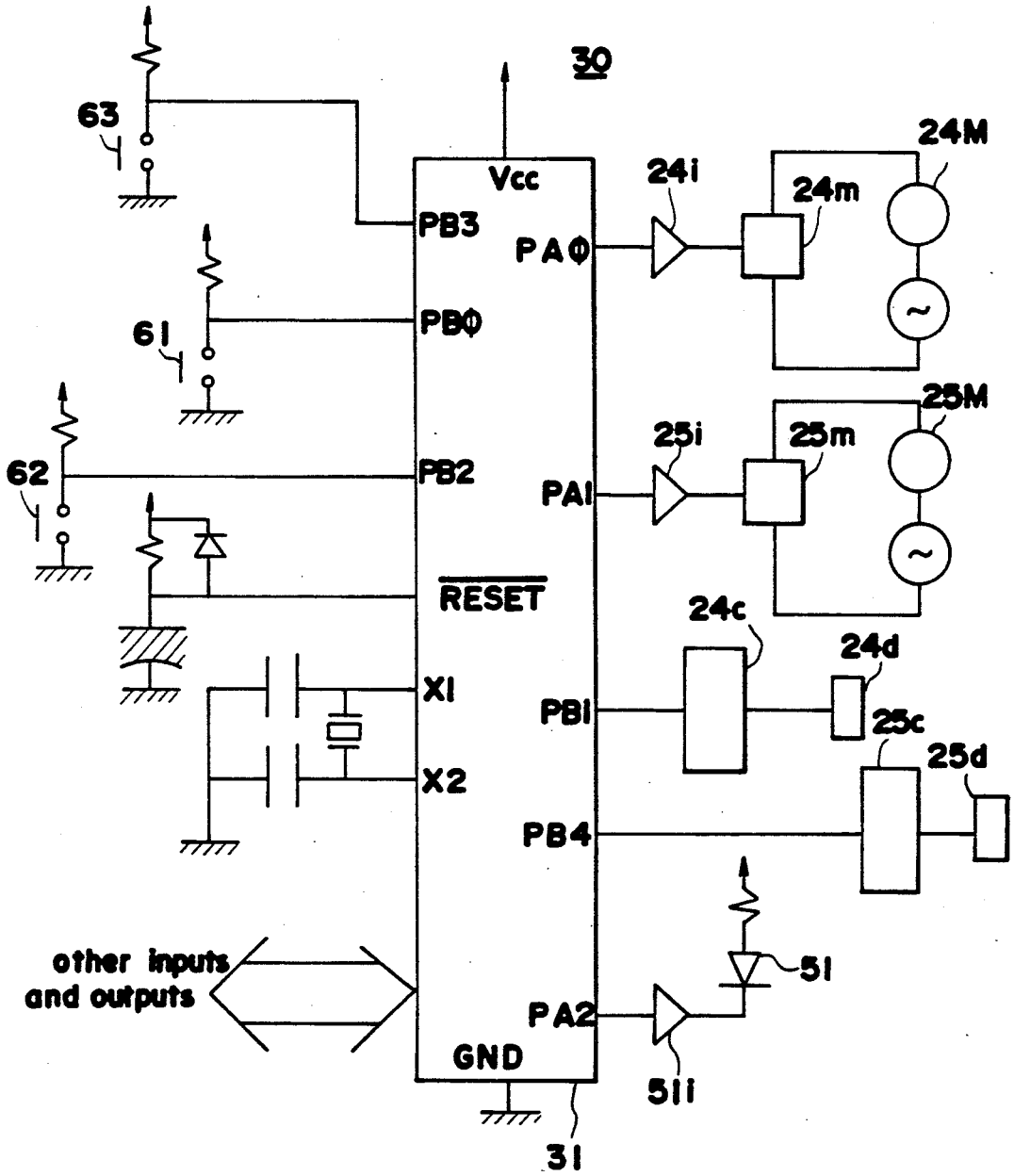

The construction of control circuit 30 for the copying machine of the first embodiment is described hereinafter with reference to FIG. 2.

The core of control circuit 30 is central processing unit (CPU) 31 which controls the operation of the copying machine by receiving signals from the input port an transmitting signals from the output port.

i. Input Point

Input ports PB0 through PB4 are described hereinafter.

When the machine operator wants emergency toner replenishment and switches ON the toner replenishment switch 61, signals from said toner replenishment switch 61 are input to input port PB0. When switch 61 is in the ON state, the input signals are low level (refer to FIGS. 11 through 13).

Figure 11:
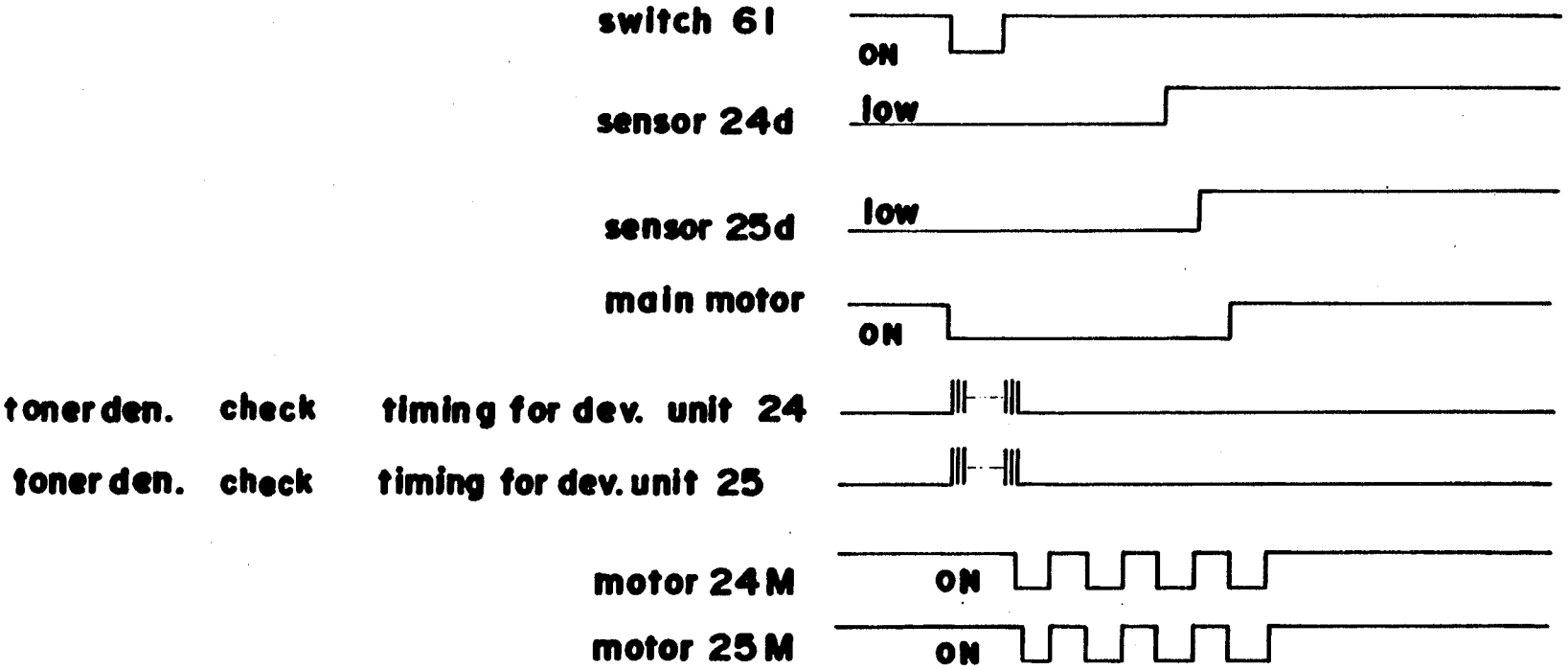
FIG. 11 is a time chart illustrating the operation by the controls shown in FIGS. 5A to 5D and FIGS. 6A to 6D.
Figure 12:
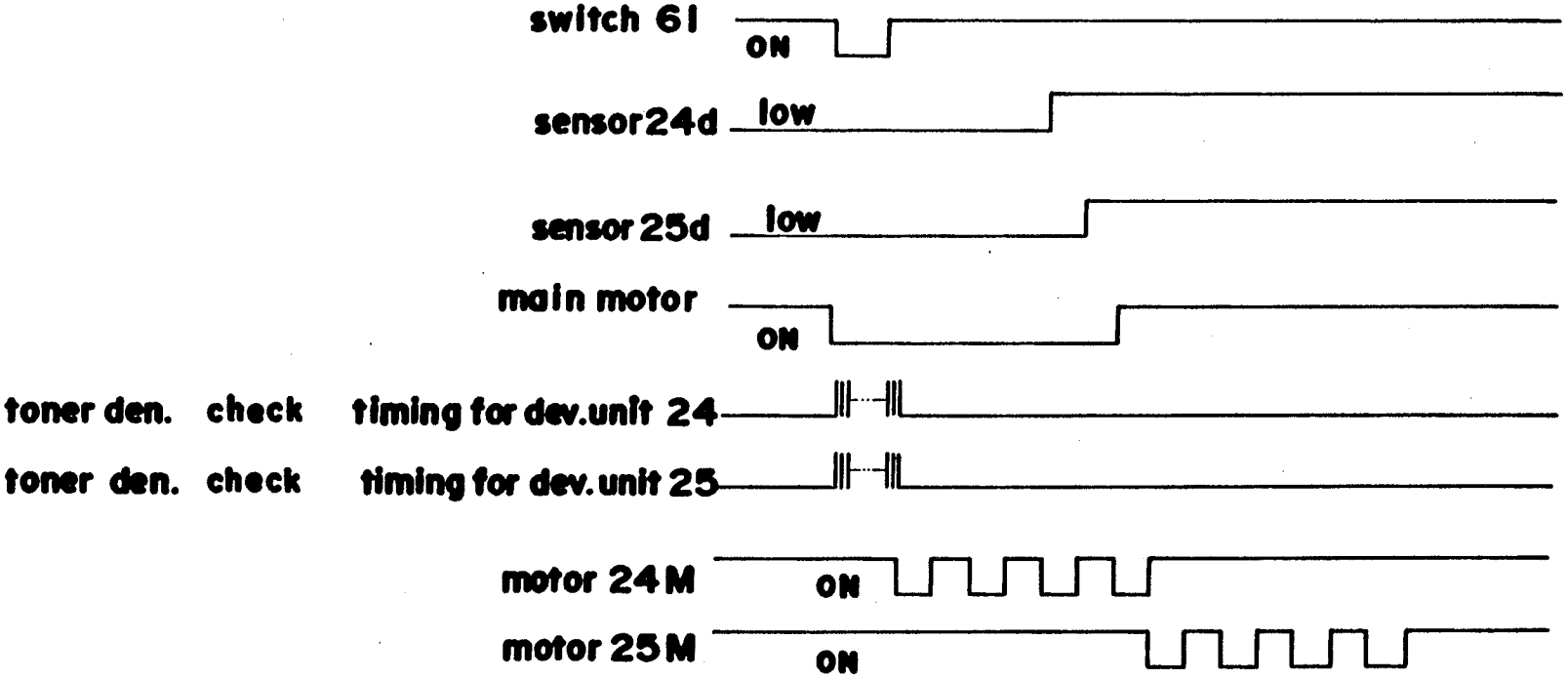
FIG. 12 is a time chart illustrating the operation by the first modification of the first embodiment.
Figure 13:
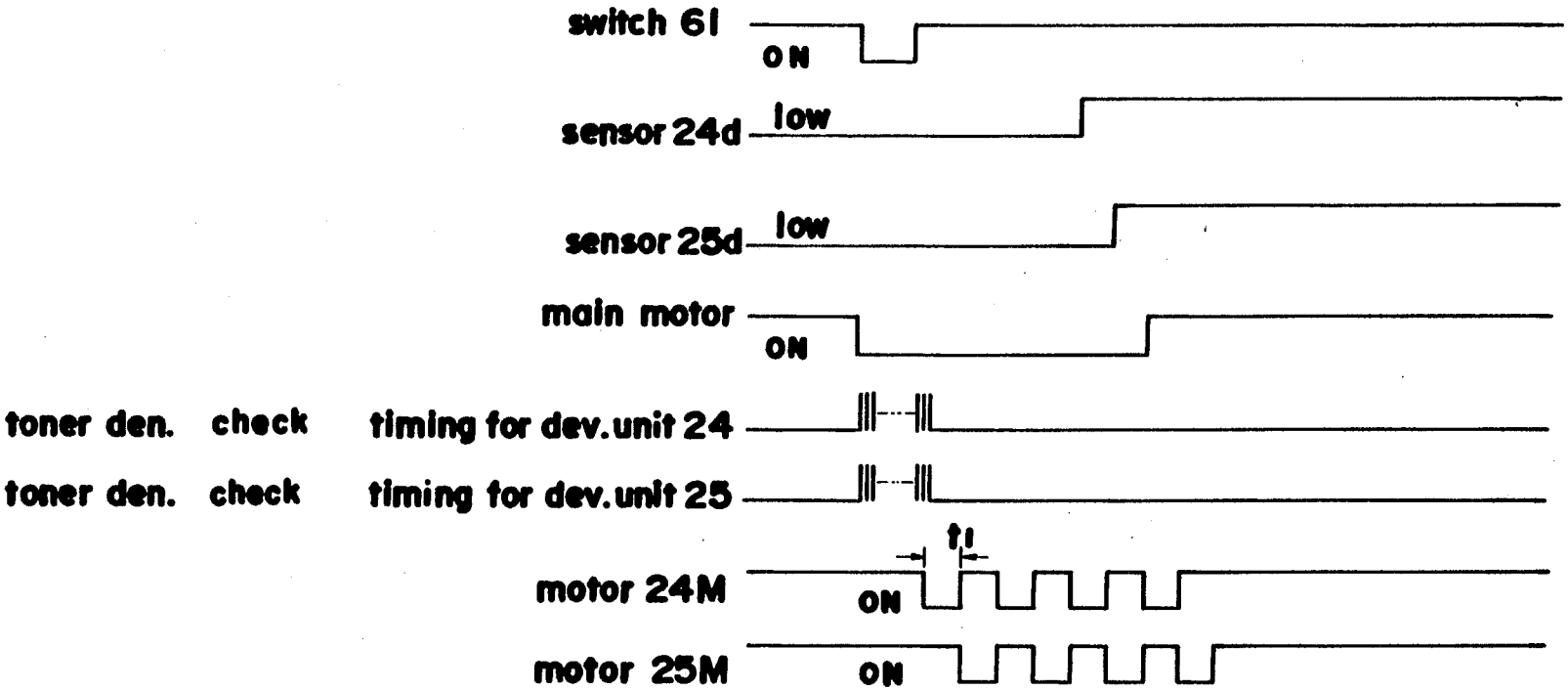
FIG. 13 is a time chart illustrating the operation by the second modification of the first embodiment.

Signals from toner density sensor 24*d* are input to input port PB1 through toner density detection circuit 24*c*. When toner density is less than 6% by weight (low) in the present embodiment, a low level signal is input (FIGS. 11 through 13).

A signal is input to input port PB2 from print start switch 62 when said print start switch 62 is switched ON by the machine operator to start the copy process. When switch 62 is in the ON state, the input signals are low level.

Signals are input to input port PB3 from clear-stop key 63 which is depressed by the machine operator to stop the copy operation or to clear the copy conditions previously set by the machine operator. When clear-stop key 63 is in the depressed state, the input signal is low level. When emergency toner replenishment is executed by toner replenishment switch 61, the signal transmitted from clear-stop key 63 and input to input port PB3 is processed as an emergency toner replenishment stop request from the operator (refer to FIG. 5, step 207).

A signal from toner density sensor 25*d* is input to input port PB4 through toner density detection circuit 25*c*. Similar to toner density sensor 24*d*, when toner density is less than 6% by weight (low), a low level signal is input (refer to FIGS. 11 through 13).

ii. Output Ports

Output ports PA0 through PA2 are described hereinafter.

Drive control signals are output from output port PA0 to drive circuit 24*m* of toner replenishment motor 24M through driver integrated circuit (IC) 24*i*. Actuation is executed when the output signal is at low level (refer to FIGS. 11 through 13).

Drive control signals are output from output port PA1 to drive circuit 24*m* of toner replenishment motor 25M through driver IC 25*i*. Similar to output port PA0, actuation is executed when the output signal is at low level.

Drive control signals are output from PA2 to toner replenishment display light-emitting diode (LED) 51 through driver IC 51*i*. LED 51 is lighted when the output signals are at low level.

iii. Other

Input and output signals other than those previously mentioned (example: drive control signals for the main motor) are collectively shown as other inputs and outputs.

X1 and X2 are clock pins.

(III) OPERATION OF THE FIRST EMBODIMENT OF THE COPYING MACHINE

Figure 3:
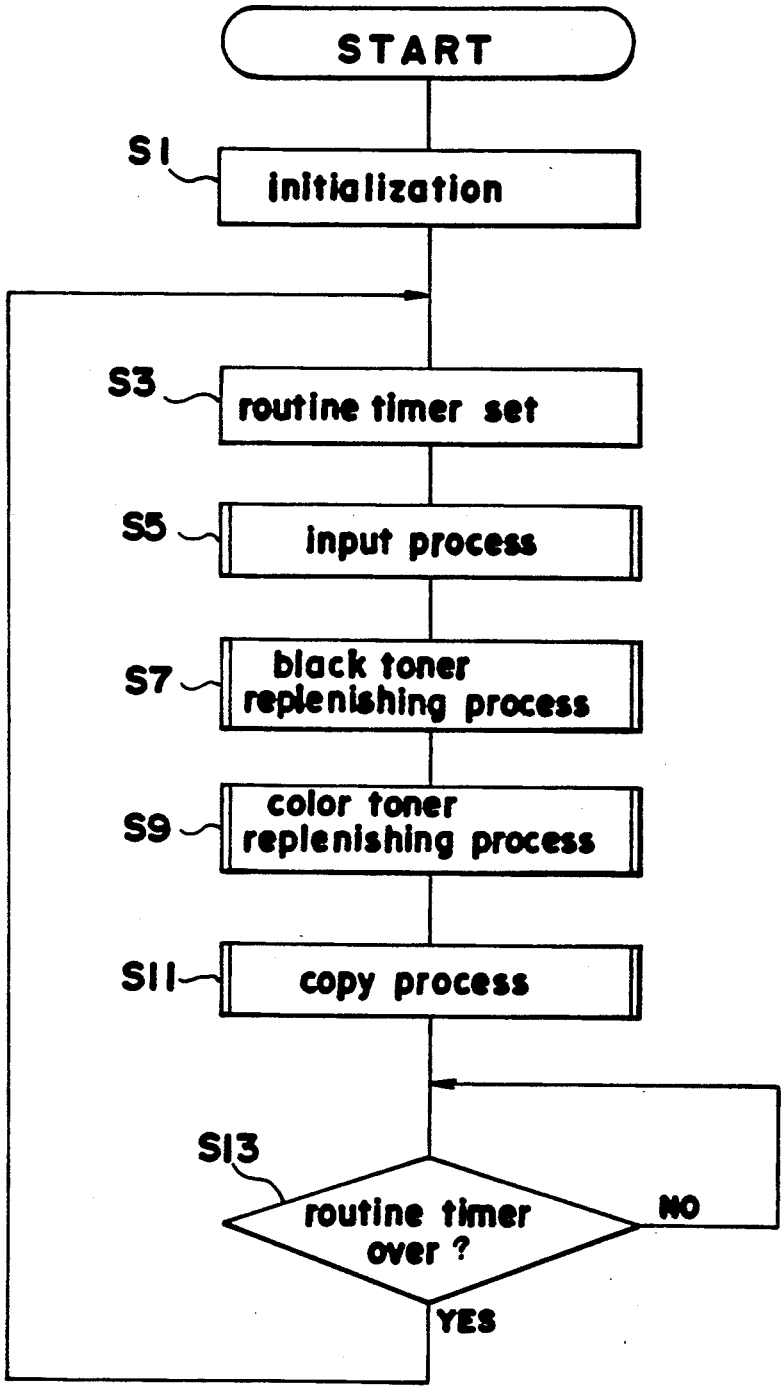

The processing of CPU 31, to wit, the operation of the copying machine, is described hereinafter.

i. Main Routine (FIG. 3)

CPU 31 starts processing when, for example, the power source is switched ON. At first, initialization is executed (step S1).

Then, in step S3, the routine timer is started and thereafter each subroutine process described below is executed as needed.

Step S5: Input process routine (process for replenishment switch 61 input; refer to FIG. 4).

Step S7: Black toner replenishment process routine (toner replenishment process for second developing device 25; refer to FIG. 5).

Step S9: Color toner replenishment process routine (toner replenishment process for first developing device 24; refer to FIG. 6).

Step S11: Copy process routine (process for controlling the copy operation, the description of which is omitted herein since said copy process routine is not directly related to the essence of the present invention).

Each of the aforesaid routines is executed. Thereafter, in the previously mentioned step S13, the end of the routine timer is awaited and after said timer has elapsed, the routine returns to step S3 and the previously described process is repeated.

Figure 4:
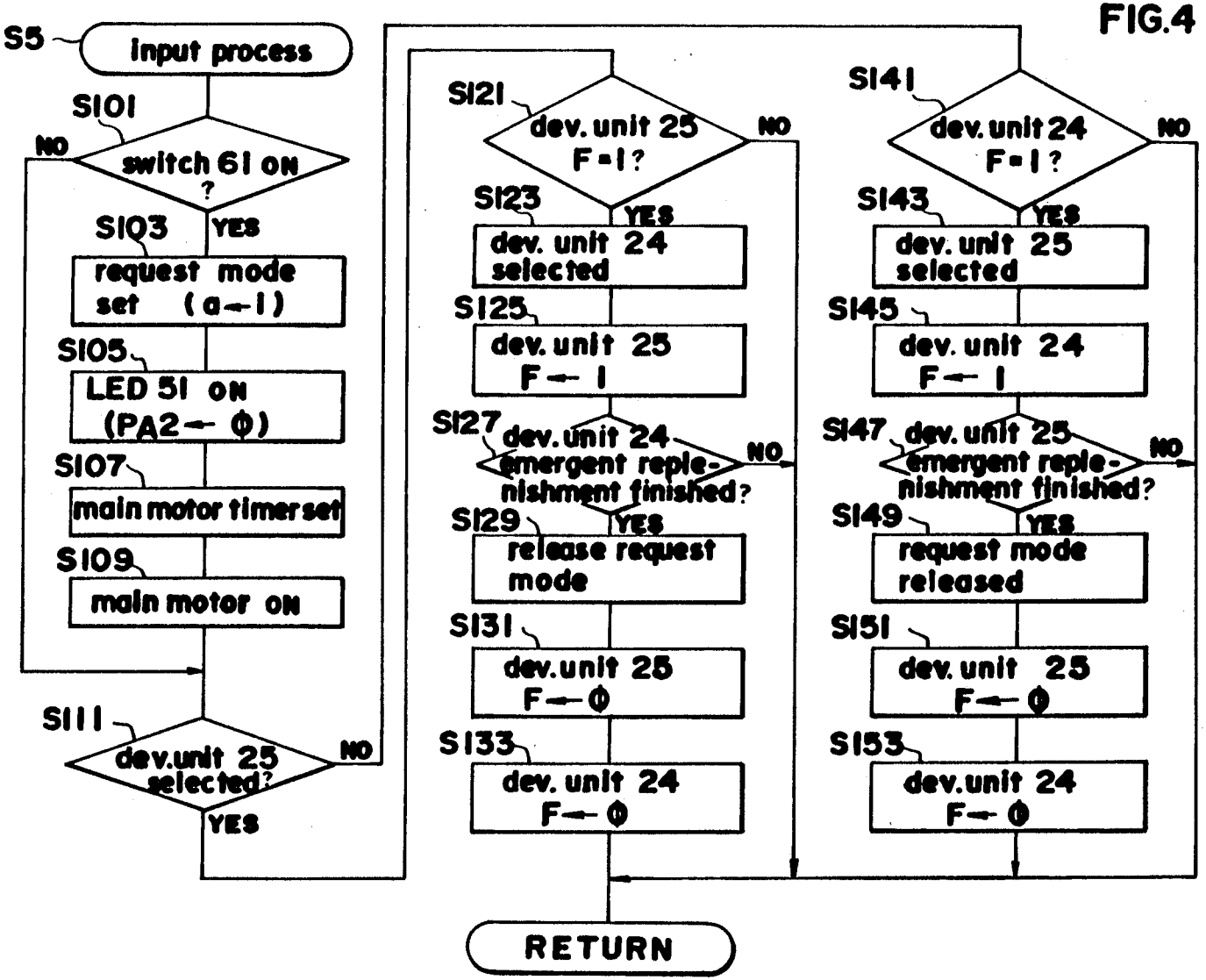

The toner replenishment processes of the present device possesses three toner replenishment modes described herein, that is, a) first replenishment mode (hereinafter referred to as "first mode"): mode for resupplying toner consumed by normal developing operation;

b) second replenishment mode (hereinafter referred to as "second mode"): mode for resupplying toner loss unrelated to normal developing operation such as toner scattering;

c) emergency replenishment mode (hereinafter referred to as "emergency mode"): mode for resupplying toner in accordance with the operation of the toner replenishment switch 61 by the operator; toner replenishment is accomplished by any of the aforementioned modes.

ii. Input Process (FIG. 4)

When toner replenishment switch 61 is switched ON (step S1, YES), the emergency toner replenishment request mode (hereinafter referred to as "request mode") is set (S103), and the toner replenishment display LED 51 is lighted (S105). At the same time, the timer for managing the main motor ON time is started (S107) and the main motor is switched ON (S109). The aforesaid process also mixes the developing material accommodated within the developing devices by means of the drive force of the aforesaid main motor.

In step S111, the currently selected developing device is checked.

The result of the aforesaid process when developing device 25 (second developing device) is selected (S111, YES) is that the routine continues to step S121, and the black developing device emergency toner replenishment completion flag is checked The black developing device emergency toner replenishment completion flag (hereinafter referred to as "black emergency replenishment completion flag") is set at [1] when the emergency toner replenishment is completed for black developing device 25, as described later (refer to step S341).

The result of the determination made in step S121 when the black emergency replenishment completion flag is set at [0], that is, when emergency toner replenishment to black developing device 25 is not yet completed (S121, NO), the program returns to the main routine. Accordingly, when the emergency is set, emergency toner replenishment to black developing device 25 is continuous refer to the black toner replenishment process).

On the other hand, in step S121, when the black emergency replenishment completion flag is set at [1], that is, when the emergency toner replenishment is completed for black developing device 25 (S121, YES), the color developing device 24 (first developing device) is selected (S123). The black emergency replenishment completion flag is maintained at [1] (step S125).

Emergency toner replenishment for color developing device 24 is executed and thereafter, when said emergency toner replenishment is completed (S127, YES), the request mode and the emergency toner replenishment mode are released (S129), and both the black and color emergency replenishment completion flags are reset to [0] (S131, S133).

On the other hand, when it is checked that color developing device 24 has been selected in the previously mentioned step S111 (S111, NO), the process in step S141 and subsequent steps are executed.

Steps S141 and S153 execute the same processes as described in the previous steps S121 through S133, except that the terms "black" and "color" are interchanged.

Figure 5:
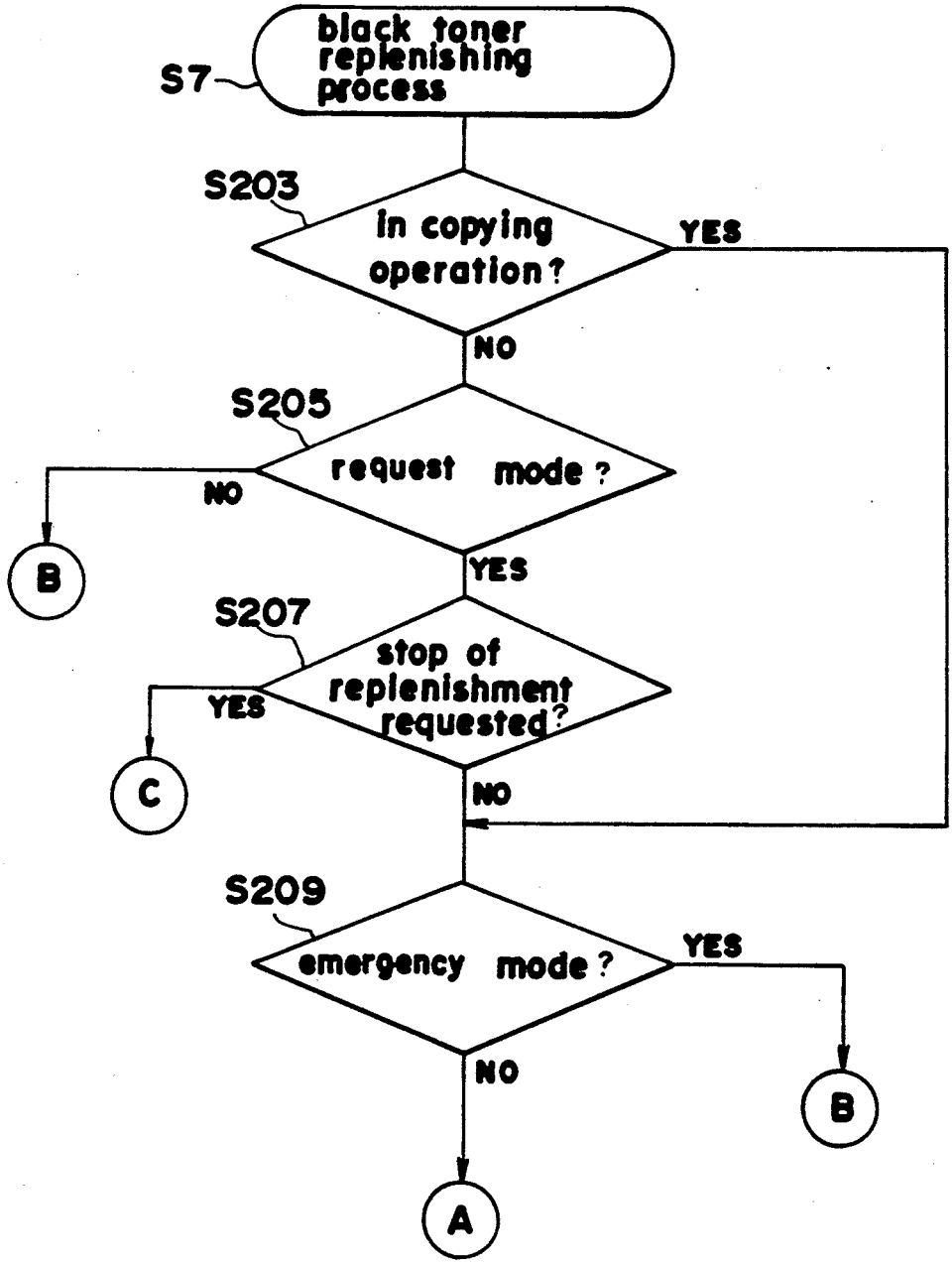

That is, after the completion of emergency toner replenishment for color developing device 24 (S141), the black developing device is selected (S143). Then, after the completion of emergency toner replenishment for black developing device 25 (S147), the request mode and emergency mode are released (S149), and both the black and color emergency replenishment completion flags are reset to [0] (steps S151 and S153).

iii. Black Toner Replenishment Process (FIG. 5)

Toner replenishment for black developing device 25 is controlled in the manner described below.

a) First Mode

An on-going copy operation is a prerequisite for normally executed first and second mode toner replenishments (S203, YES). The program then jumps to steps S205 and S207.

Since the determination made in step S209 is originally NO, the routine continues to step S211.

First, in step S211, the number of times of the density check is checked. The "density check" expresses a comparison of the relative relationship of the toner density detected by the toner density sensor 25*d* and a set value, and the check made in step S231, described later, corresponds to the aforesaid comparison.

The results of the aforesaid determination when the number of times of the density check is "0" is that in step S221 after verification of a pause of a specified interval from the previous "density check," the routine continues to step S223 and a determination is made as to whether or not the second mode has been set by flag c which is raised during normal toner density. When it is determined that the second mode has been set (c=1), the routine jumps the process of steps S225 through S235 to continue from step S291 to resupply a specified quantity of toner. The "specified quantity of toner" expresses the small quantity of toner estimated to be consumed naturally, such as the toner scattered outside the developing device, and is unrelated to the development of electrostatic latent images. The aforesaid specified quantity is determined by means of a second mode. timer.

In step S223, when flag c=0, that is, when it is checked that the second mode has not been selected, the completion of the timer set previously in step S107 is awaited (S225), then the routine continues to step S231 where a comparison is made between the detected toner density and a set value. More specifically, a check is made of the level of the signal input to input port PB4 of CPU 30 from the toner density sensor 25*d* through toner density detection circuit 25*c*. When the toner density detected in step S231 is less than a specified value, the counter (for determining "low" density) is incremented by [1], then the routine continues to step S235. When the toner density detected in step S231 exceeds the specified value, the routine continues to step S235.

In step S235, the density counter is incremented by [1]. The aforesaid counter is used for checking the number of times of the density check in the previously described step S211.

When the number of times of the density check is 1 through 18, the routine jumps the process of steps S221 through S225 to continue from step S231 where a comparison is made between the detected toner density and a set value.

The result of the check made in step S211 is that when the number of times of the density check is "19", the routine continues to step S241 and the density counter is cleared.

Next, in step S251, a comparison is made between the detected toner density and a specified value. That is, when the number of times of "low" density check is a majority among 19 times of density check (the check in step S231), such that the dectected toner dinsity is determined to be less than the specified value and the routine continues to step S281. In step S281, when the request mode has not been selected, the first mode flag [d] is set at [1] to set the first mode in step S285. Thereafter, a low density counter is cleared (S275).

Thus, when the first mode is set, the normal toner replenishment process is executed in the copy process subroutine (S11). The normal toner replenishment process is the process for replenishing a specified quantity of toner each time the number of copy sheets reaches a specified number of sheets.

The first mode is released (S307) by shutting OFF the main motor.

b) Second Mode

When the number of times of "low" density check in the previously described step S251 is 10 cycles or less (step S251, YES), execution of normal toner replenishment is not required. In this instance, under the condition that the request mode is not specified (step S261, NO), the second mode toner replenishment is executed.

That is, toner replenishment motor 25M is switched ON (S267) and toner replenishment begins. Further, the second mode timer for managing continuous toner replenishment is started (S269), and the second mode is set (S271). In addition, first mode is released (S273) and the low-density-conter is cleared (S275).

Thus, when the second mode is set, toner replenishment is continuous until the completion of the aforesaid second mode timer.

Thereafter, the timing of the second mode timer completion (S297, YES) switched OFF the toner replenishment motor 25M (S303), thereby toner replenishment is terminated. Then, the second mode is released (S305). Further, completion of the copy operation (S299, NO) switched OFF the main motor (S301).

Thus, when the second mode is selected toner replenishment is executed during the time managed by the second mode timer. The second mode resupplies the small amount of toner lost as airborne particles and is unrelated to the operation for developing the electrostatic latent image.

c) Emergency Mode

As previously described, when toner replenishment switch 61 is switched ON (S101, YES), the request mode is set (S103).

Therefore, when toner density is low in step S251 (S251, NO), a "YES" determination is made in step S281, such that the emergency mode is set in step S283.

When the emergency mode is set, a "YES" determination is made in step S295, and the process moves to step S311 and subsequent steps.

The process in steps S311 to S339 execute a total of four cycles of toner replenishment with a specified time interval. That is, one emergency toner replenishment is completed through four cycles of toner-replenishment. Executing the emergency toner replenishment operation divided in four cycles is done in consideration of the time required to mix the developing material accommodated in the developing devices. Therefore, nonuniformity in toner density is prevented by mixing the developing material four times during emergency toner replenishment.

First, the intermittent counter for counting the number of executions of emergency toner replenishment is set (S311).

When the intermittent counter value is [0] (S311, YES), neither the OFF timer and ON timer are set (S321, NO; S323, NO), so that the toner replenishment motor 25M is switched ON (S327), emergency toner replenishment is started and the ON timer for managing the continuous first cycle of emergency toner replenishment is started (S329). Therefore, the initial cycle of emergency toner replenishment is executed until the completion of the ON timer.

When the ON timer is completed (S331, YES), toner replenishment motor 25M is switched OFF (S333). Accordingly, the emergency toner replenishment is temporarily stopped. At the same time, the OFF timer is started that manages the stopping time until the next emergency replenishment cycle (S335).

When the OFF time is started, the determination made in step S321 is "YES," and the process of steps S323 through S335 is jumped during the continuous running of the OFF timer.

Thereafter, when the aforesaid OFF timer is completed (S337, YES), the previously mentioned intermittent counter is incremented (S339).

Further, because a "NO" determination is made in step S321, emergency toner replenishment is restarted and the process is executed in the same manner previously described.

The process of steps S321 through S339 are repeated until the value of the intermittent counter reaches [4], whereupon emergency replenishment is executed intermittently for a total of four cycles.

Figure 6A:
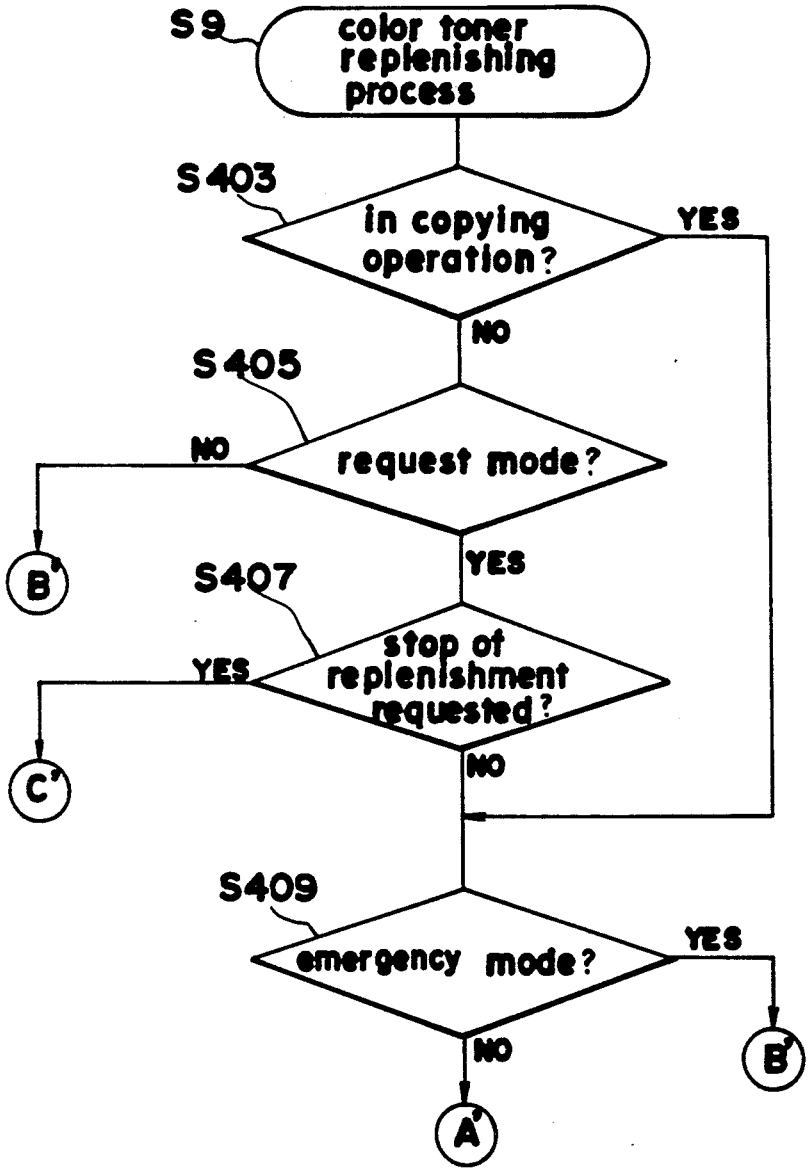
Figure 6:
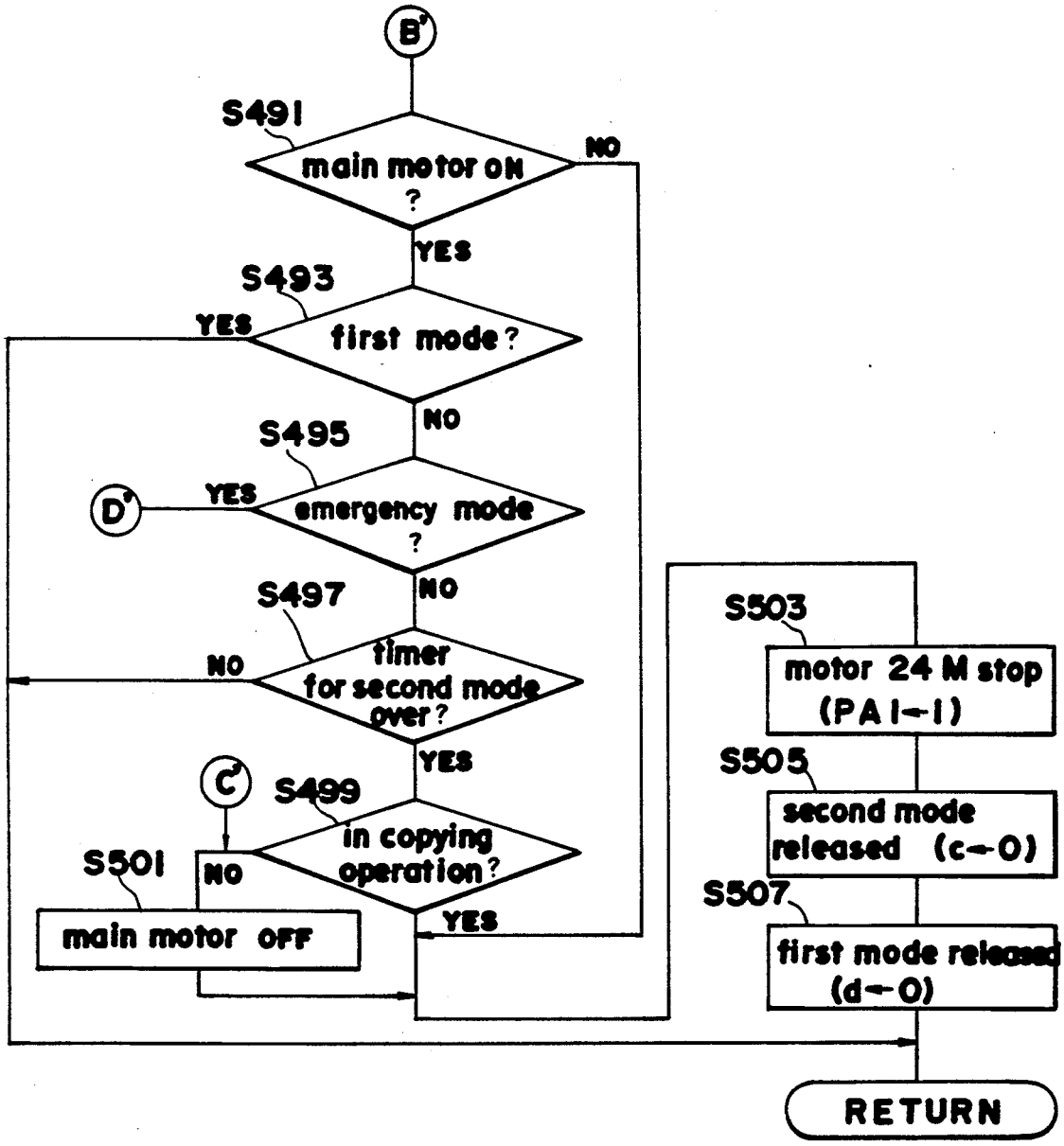

When the intermittent counter values exceeds 4 (S311, NO), emergency toner replenishment is completed, and the emergency black replenishment completion flag is set at [1] (S341).

iv. Color Toner Replenishment Process (FIG. 6)

The color toner replenishment process is executed in the same manner as the previously described black toner replenishment process.

The points of departure between the processes are:

a) the toner density detection subject is color developing device 24 (S231 becomes S431), b) the toner replenishment control subject is the toner replenishment motor 24M of color developing device 24 (S267 becomes S467, S303 becomes S503, S327 becomes S527, S333 becomes S533).

In the previously described controls, emergency toner replenishment is accomplished simultaneously for the two developing devices 24 and 25. Therefore the time required for emergency toner replenishment is minimized.

v. First Modification of the Control for Toner Replenishment in the Second Embodiment A first modification of toner replenishment control is described hereinafter with reference to FIGS. 7, 8 and 12.

Figure 5B:
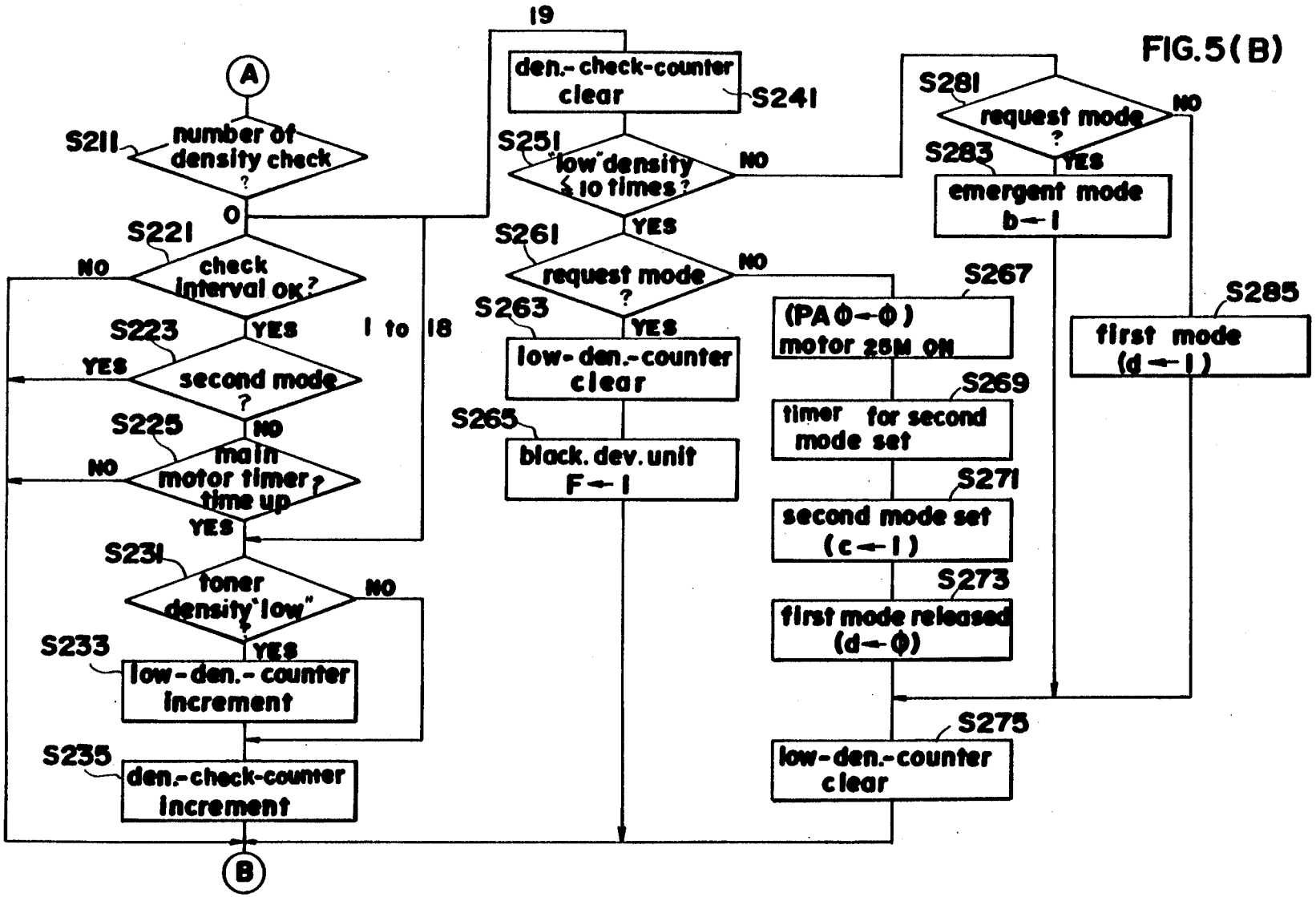
Figure 5C:
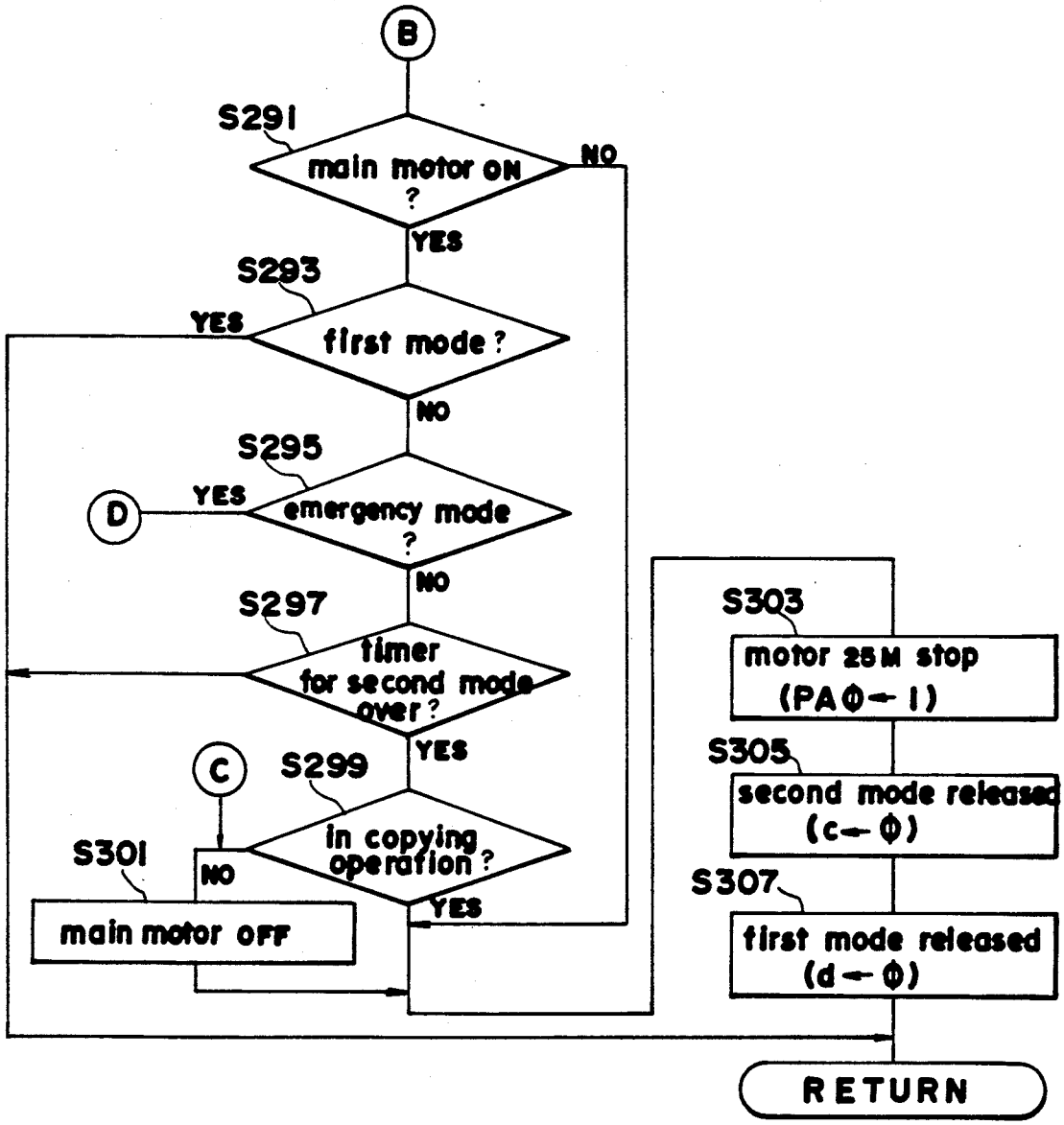
Figure 5:
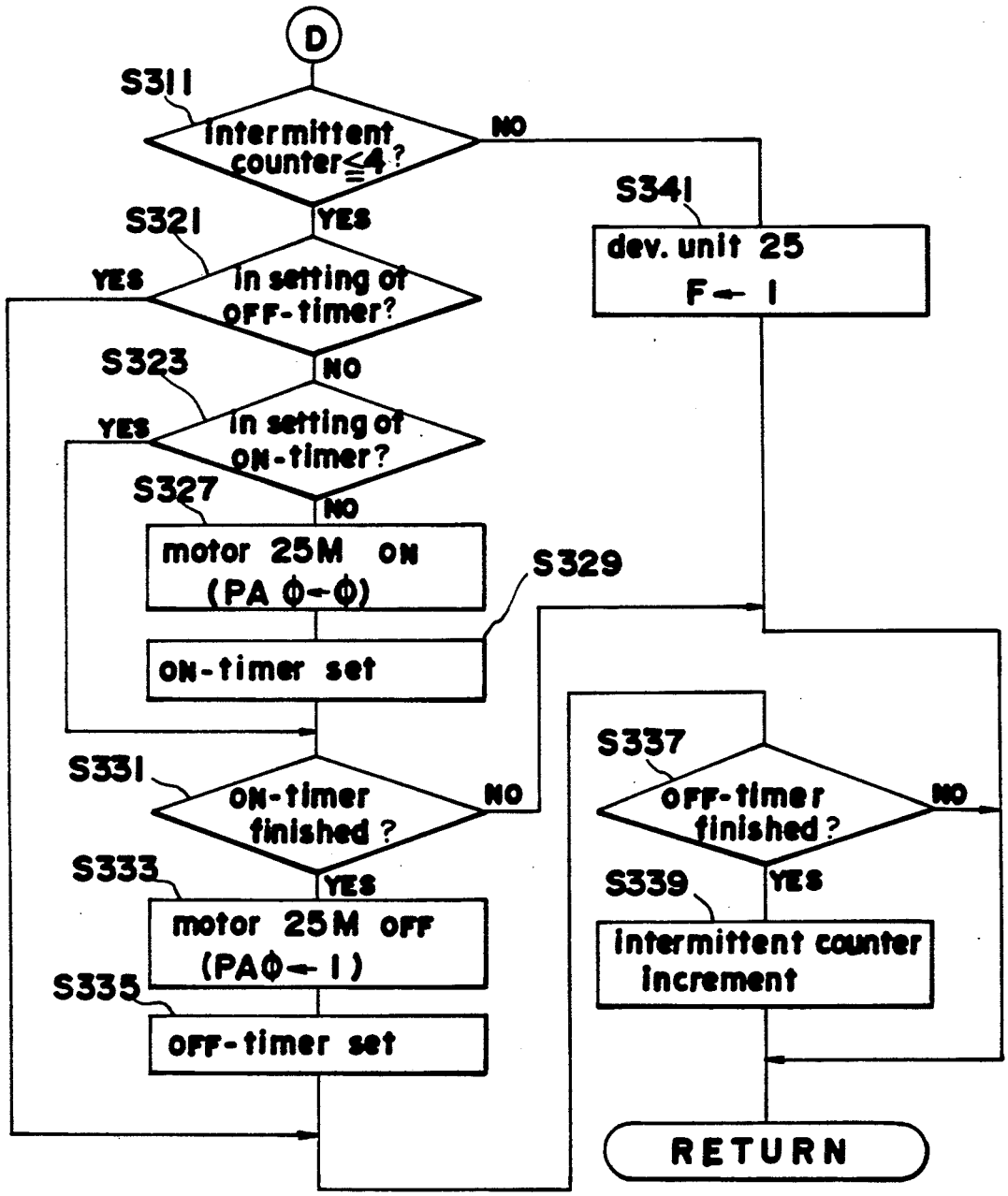
Figure 6D:
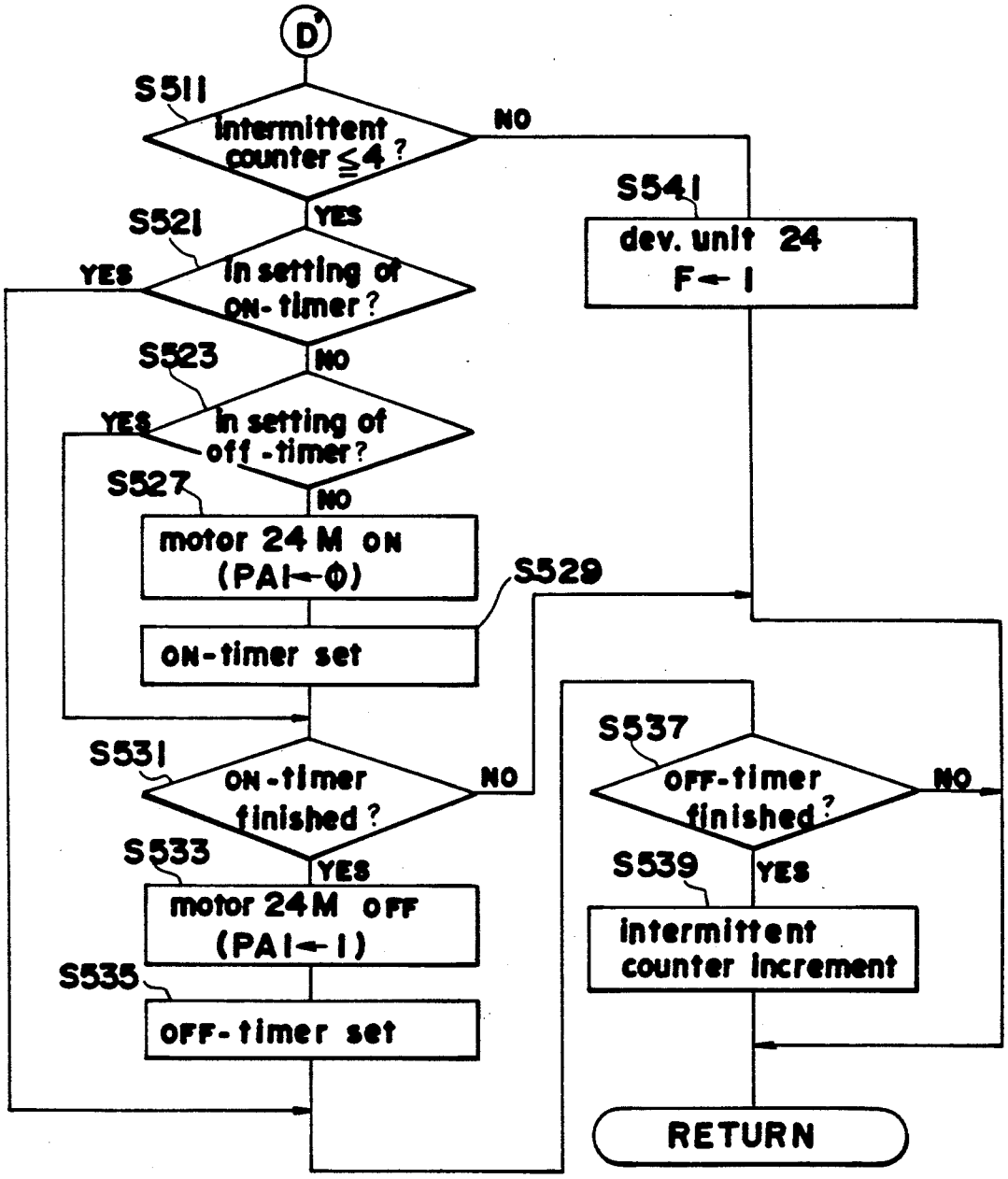
Figure 7:
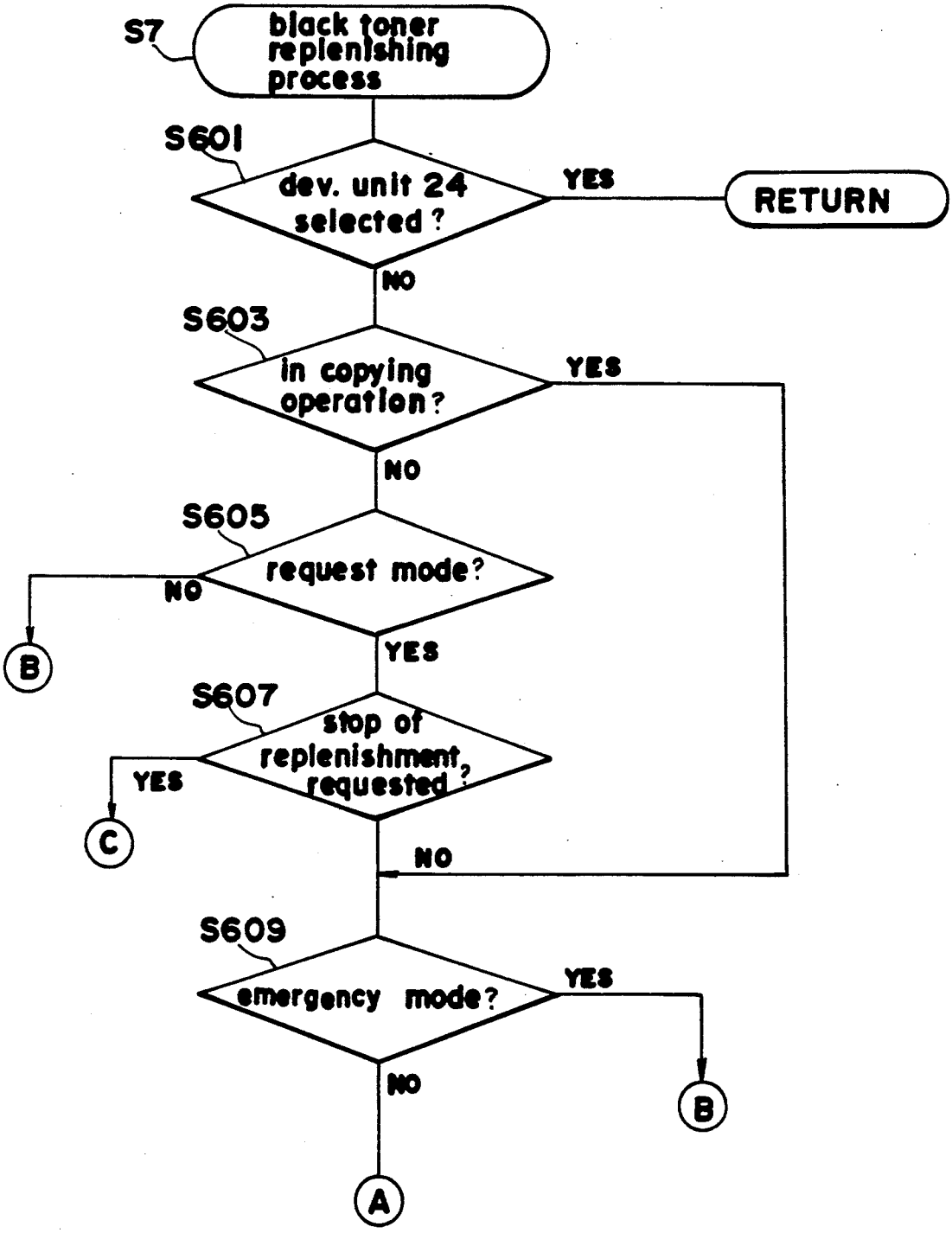
FIG. 7 is a flow chart showing a portion of the subroutine of the black toner replenishment process in a first modification of the control used in the first embodiment.
Figure 8:
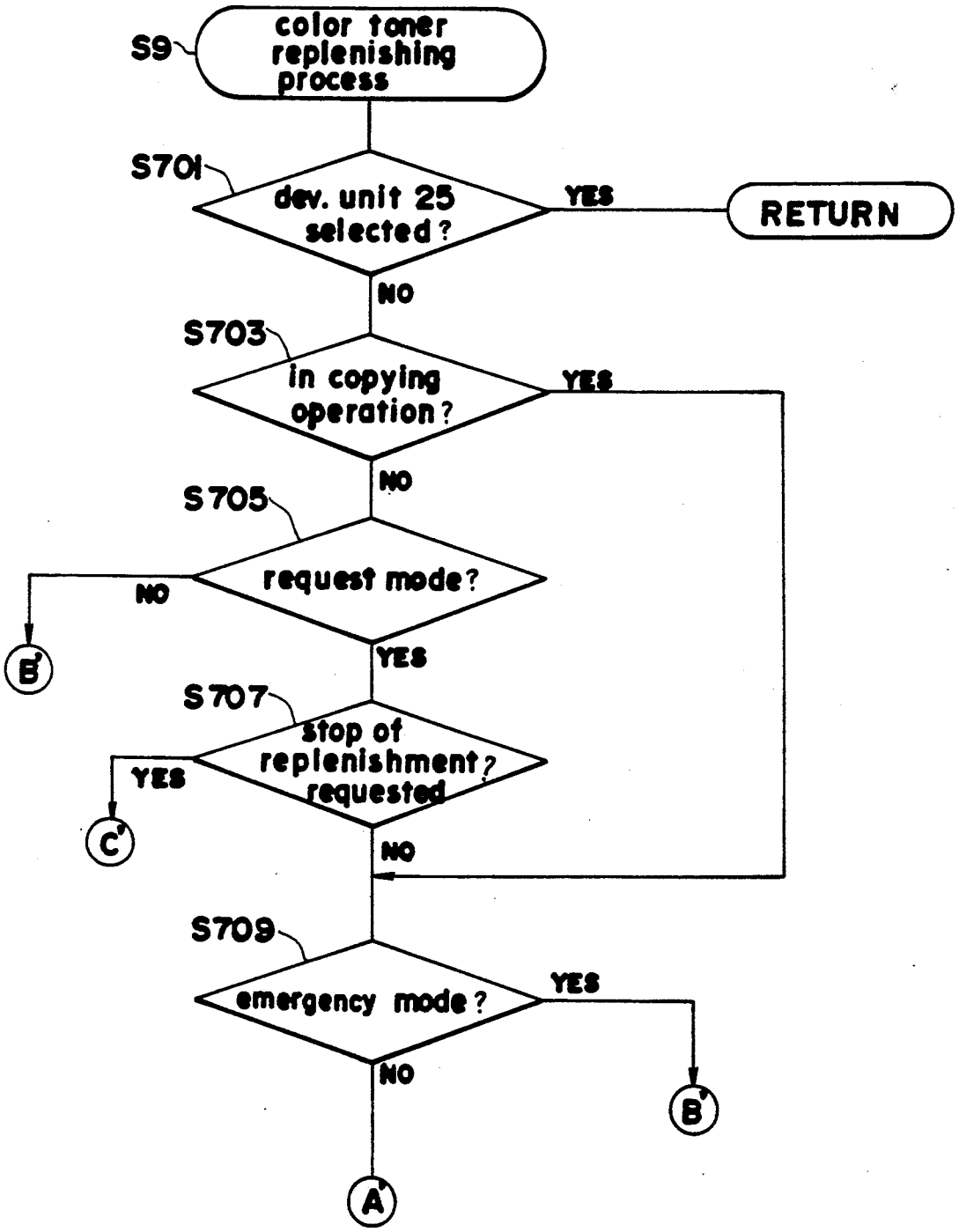
FIG. 8 is a flow chart showing a portion of the subroutine of the color toner replenishment process in the aforesaid first modification.

FIG. 7 is an illustration of the first modification corresponding to FIG. 5A of the first embodiment. The process executed after step S609 in FIG. 7 is identical to that described in steps S211 through S341 in FIGS. 5B through 5D. FIG. 8 is an illustration corresponding to FIG. 6A of the first embodiment. The process executed after step S709 in FIG. 8 is identical to that described in steps S411 through S541 in FIGS. 6B through 6D.

The first modification of the toner replenishment control is substantially similar to the control of the previously described first embodiment, except for the points of departure described hereinafter.

That is, in the first modification of the toner replenishment control, the black toner replenishment process (S7) is executed under condition that color developing device 24 has not been selected (S601). Similarly, the color toner replenishment process (S9) is executed under condition that black developing device 25 has not been selected (S701).

Accordingly, toner replenishment control in the first modification does not simultaneously switch ON toner replenishment motors 24M and 25M, as shown in the timing chart of FIG. 12. That is, during emergency toner replenishment the replenishment process is executed for the selected developing device, and thereafter the replenishment process continues to the non-selected developing device (refer to S121, S123).

In the toner replenishment control of the first modification, after emergency toner replenishment is accomplished for the selected developing device, processing continues and emergency toner replenishment is automatically accomplished for the non-selected developing device. Therefore, the time required for emergency toner replenishment is shorter than that of conventional processing and the load on the power circuit does not become excessive because toner replenishment motors 24M and 25M are not driven simultaneously.

vi. Second Modification of the Control for Toner Replenishment in the First Embodiment A second modification of toner replenishment is hereinafter described with reference to FIGS. 9, 10 and 13.

Figure 9:
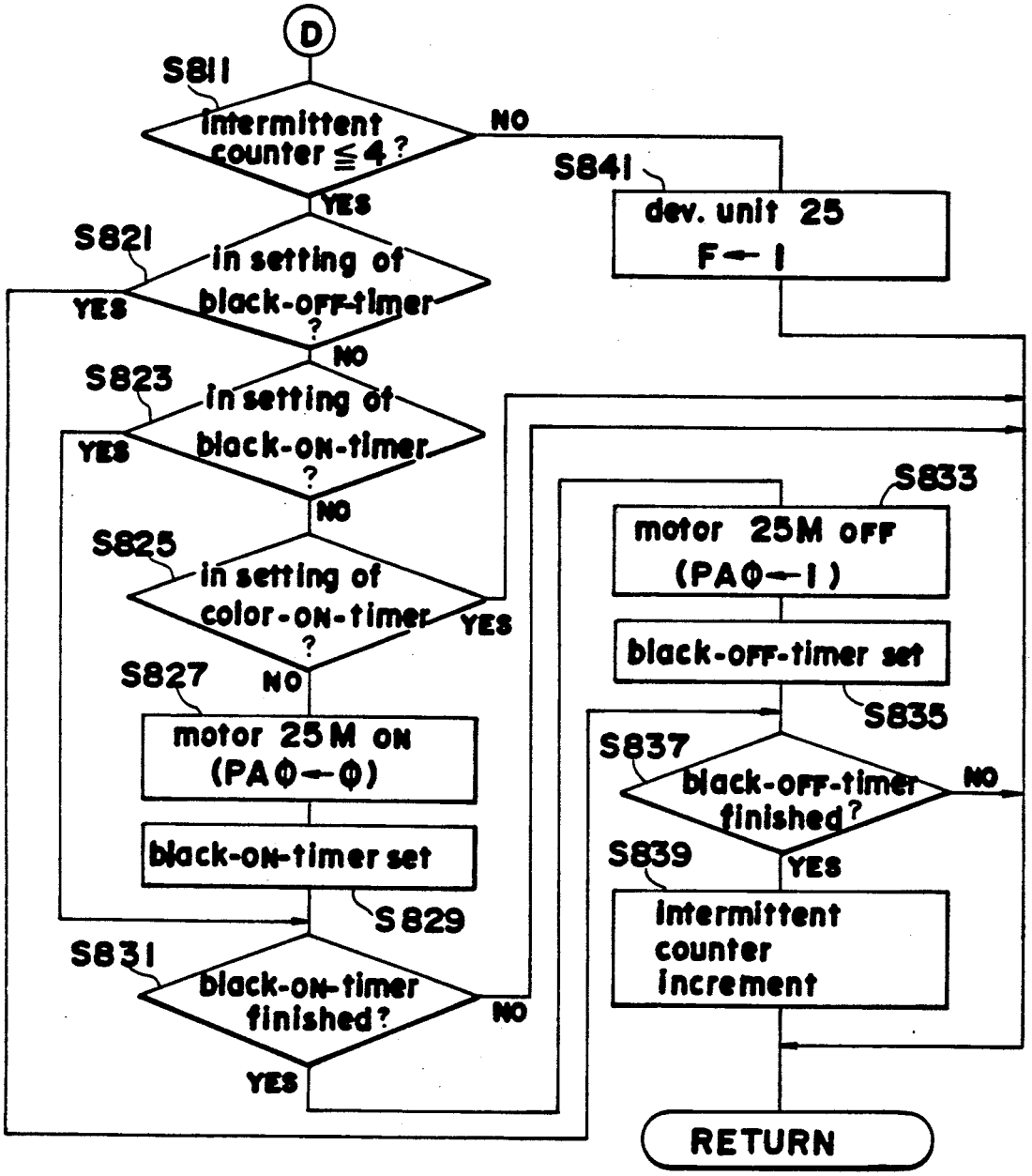
FIG. 9 is a flow chart showing a portion of the subroutine of the black toner replenishment process in a second modification of the control used in the first embodiment.
Figure 10:
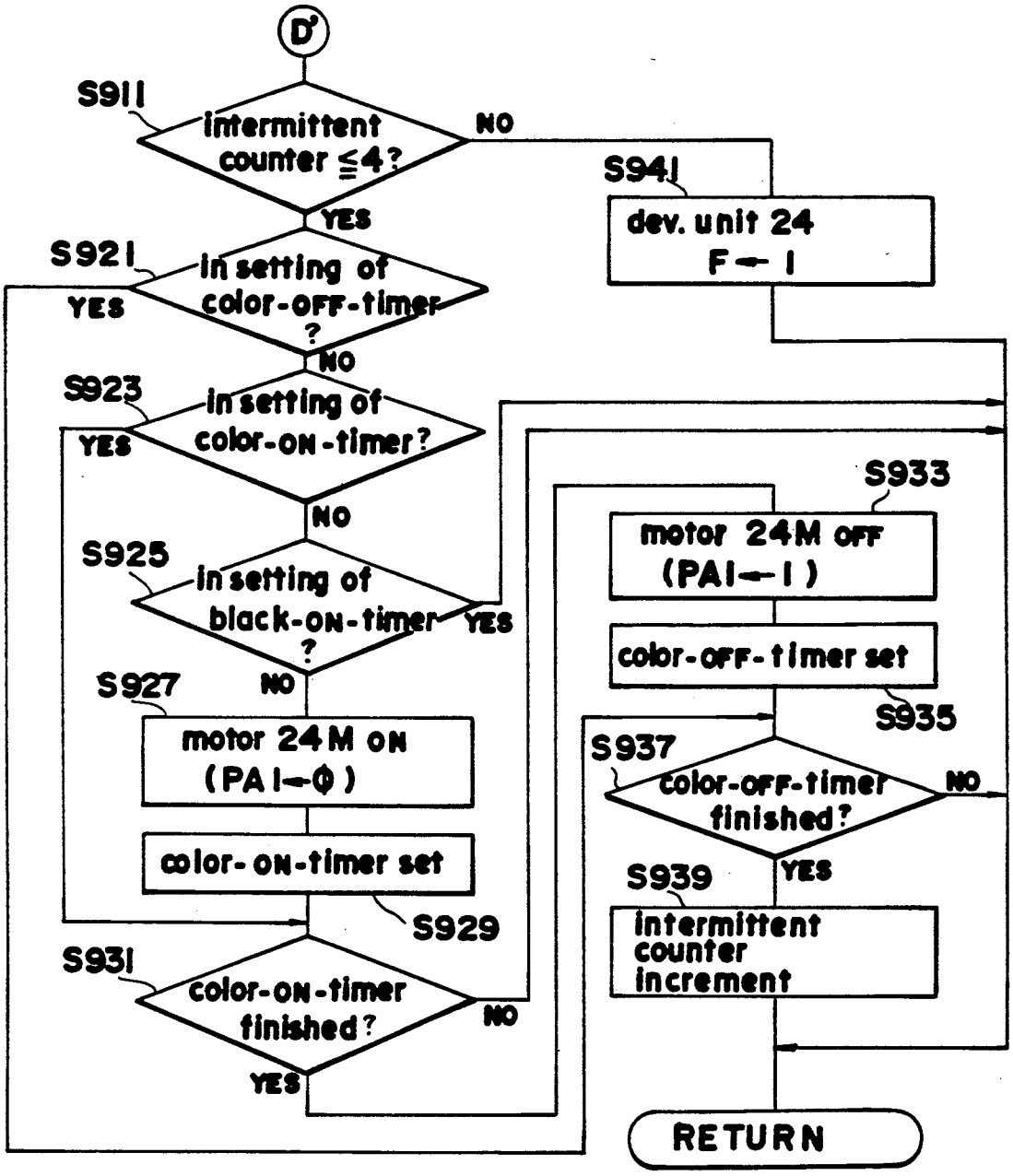
FIG. 10 is a flow chart showing a portion of the subroutine of the color toner replenishment process in the aforesaid second modification.

FIG. 9 is an illustration corresponding to FIG. 5D of the first embodiment. The process executed prior to step S811 in FIG. 9 is identical to that described in steps S203 through S307 in FIGS. 5A through 5C. FIG. 10 is an illustration corresponding to FIG. 6D of the first embodiment. The process executed prior to step S911 in FIG. 10 is identical to that described in steps S403 through S507 in FIGS. 6A through 6C.

The second modification of toner replenishment control is substantially similar to the control of the previously described first embodiment, except for the points of departure described hereinafter.

In the second modification of toner replenishment control, black toner emergency replenishment and color toner emergency replenishment are mutually separated by non-toner replenishment intervals managed by a black ON timer and black OFF timer and a color ON timer and color OFF timer, respectively, and are alternately executed. The non-toner replenishment intervals are pause intervals between the emergency toner replenishment executed in a total of four intermittent cycles relative to each black toner and color toner.

First, the intermittent counter is set (S811) in the same manner as described in the toner replenishment control of the first embodiment.

Since the initial counter value is [0] the routine continues to step S821 and subsequent steps.

Determinations made in steps S821, S823 and S825 are initially "NO." Then, the routine continues to step S827 where black toner replenishment motor 25M is switched ON, and then the black ON timer is started S829. During the continuous operation of the black ON timer, emergency toner replenishment is executed for black developing device 25 in the same manner previously described for toner replenishment control in the first embodiment. During this time, emergency toner replenishment for color developing device 24 is prohibited (refer to step S925, YES).

Subsequently, when the black ON timer is completed (S831, YES), black toner replenishment motor 25M is switched OFF (S833), and the black OFF timer is started (S835). Thus, emergency toner replenishment for black developing device 25 enters a pause interval (S821, YES).

On the other hand, color toner replenishment motor 24M is switched ON (S927) because the emergency toner replenishment inhibition is released for color developing device 24 (S925, NO), and the color ON timer is started (S929). Thus, during the continuous operation of the color ON timer, emergency toner replenishment is executed for color developing device 24 in the same manner as previously described for black developing device 25. During this time emergency toner replenishment is inhibited for black developing device 25 (S825, YES).

Accordingly, emergency toner replenishment for black developing device 25 and color developing device 24 is executed in four cycles during alternating pause intervals, as shown in FIG. 13.

In the second modification of toner replenishment control described above, emergency toner replenishment for a selected developing device and emergency toner replenishment for a non-selected developing device are alternately executed during alternating pause intervals. Therefore, the time required for emergency toner replenishment is less than the time required in the previously described first modification of toner replenishment control, and the load on the power circuit does not become excessive because toner replenishment motors 24M and 25M are not driven simultaneously.

A second embodiment of the present invention is described hereinafter.

The apparatus of the second embodiment is a full color copying machine capable of producing color images by combining toners comprising the three primary colors of red, green and blue.

(I) CONSTRUCTION NEAR DEVELOPING DEVICES i. Optical scanning system

Figure 14:
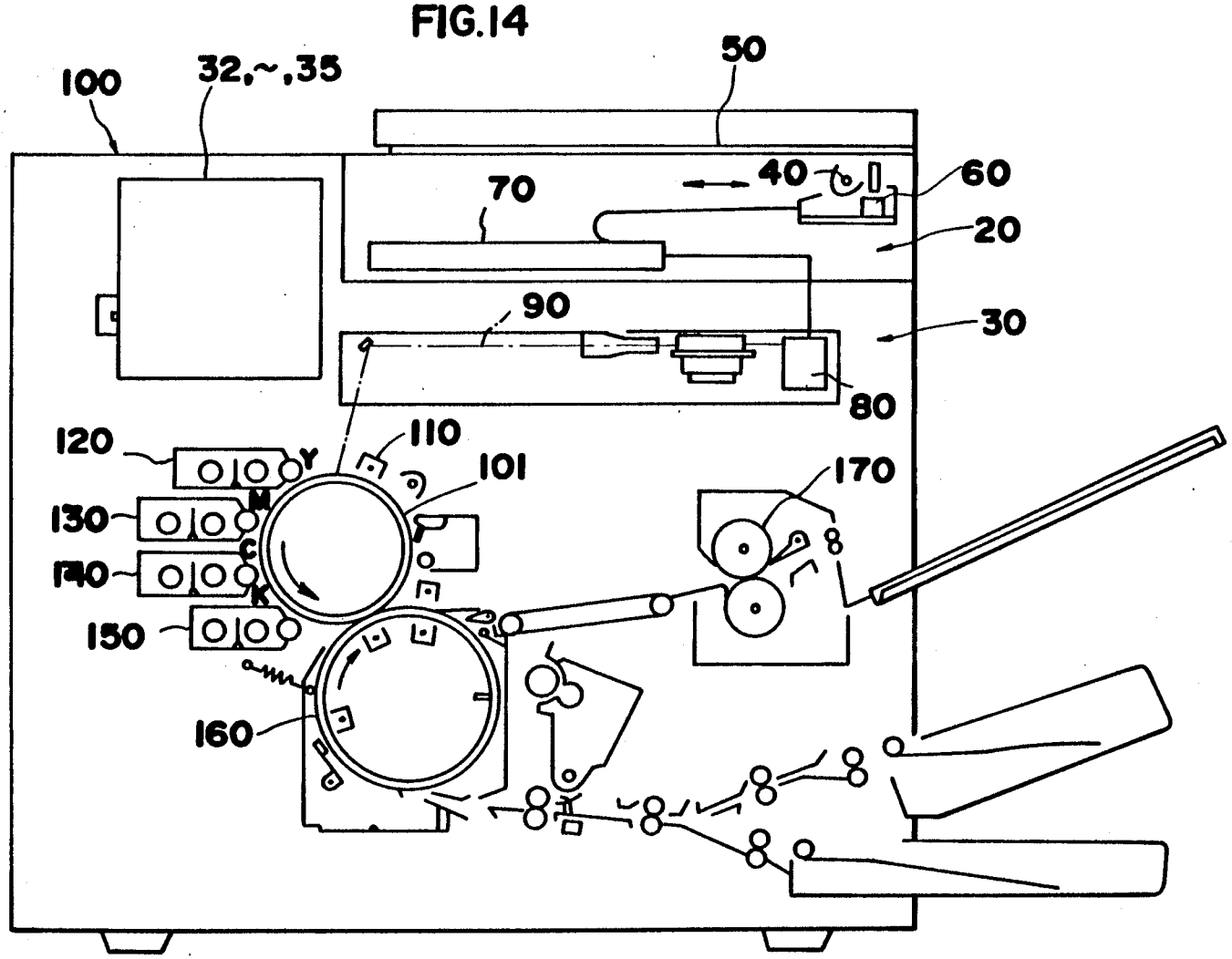
FIGS. 14 through 20 are illustrations relating to a second embodiment of the invention.

FIG. 14 is a section view of a full color copying machine. Copying machine 100 comprises a document reading portion 20 and a printing portion 30.

In document reading portion 20, an original document (not shown in the drawing) is disposed on a document platen 50 and scanned by lamp 40, such that a line sensor 60 is exposed to the light reflected from said document and the reflected light is read as color signals of the three primary colors red (R), green (G) and blue (B). The aforesaid color signals are converted in image processing circuit 70 to four values of electrical signals comprising yellow (Y), magenta (M), cian (C) and black (K).

In the printer portion 30, a laser drive control portion 80 is actuated based on the aforesaid electrical signals, and a laser beam 90 scans the surface of a photoconductive drum 101.

ii. Periphery of Photoconductive Drum

Photoconductive drum 101 is electrically charged by charger 110, and exposed to the previously mentioned laser beam 90 so as to form an electrostatic latent image thereon which is then developed by developing devices 120 through 150 so as to form a toner image which is subsequently transferred to a paper sheet (not shown in the drawing) supported on the exterior surface of transfer drum 160.

Developing devices 120 through 150 use two-component toners comprising a toner and a carrier as the developing material. Developing devices 120 through 150 respectively accommodate yellow toner, magenta toner, cian toner and black toner.

The previously mentioned electrical signals are output color-by-color to laser drive control portion 80, for example, the yellow (Y) portion of the electrostatic latent image is formed in the first cycle exposure, and yellow toner from developing device 120 is supplied to develop said portion of the image.

That is, charging, exposure, developing and transferring processes are executed for each color, and the yellow (Y), magenta (M), cian (C) and black (K) toner images are sequentially formed on the paper.

When the transfer of all toner images is completed the paper is transported to fixing device 70 where said toner images are thermally fixed on the paper and said paper is then discharged.

iii. Developing Device

Figure 15:
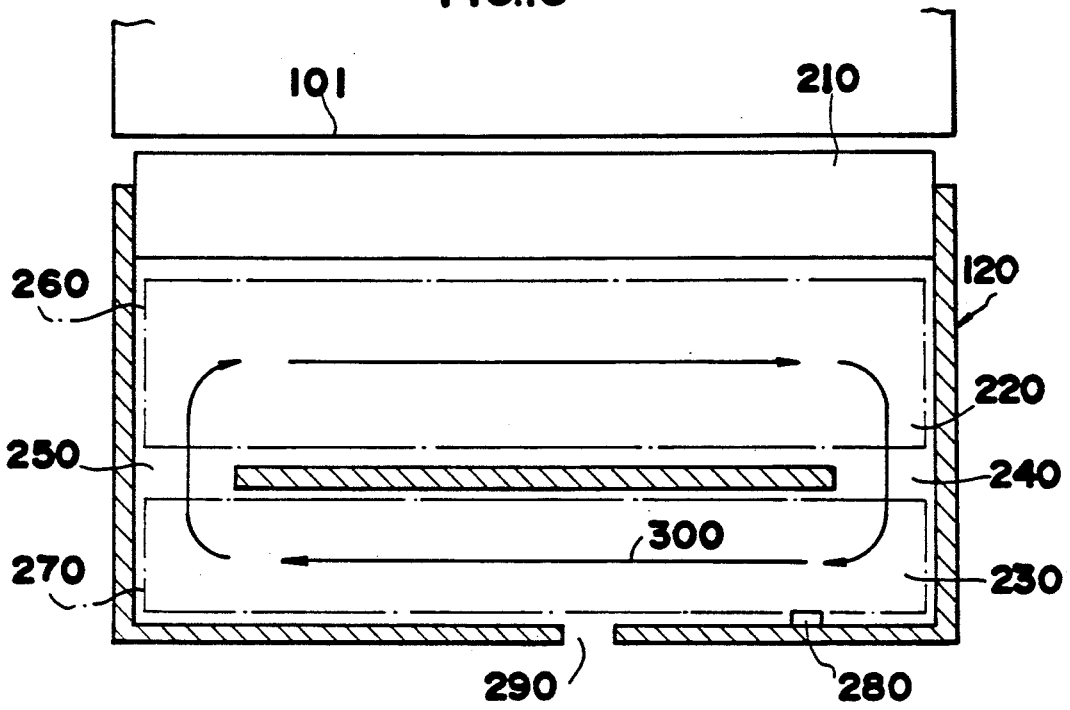

FIG. 15 is a section view showing the essential construction of developing devices 120. The developing devices 120 through 150 identically constructed.

In the drawing, developing sleeve 210 accommodates a plurality of internal magnets extending in the axial direction and arranged parallel to the photoconductive drum 101 so as to have a small spacing therebetween. Developing material supply path (hereinafter referred to as "supply path") 220 and developing material mixing path (hereinafter referred to as "mixing path") 230 are formed behind developing sleeve 210, and screw or like transport members 260 and 270 are provided therein.

Supply path 220 and mixing path 230 accommodate developing material therein. The developing material in supply path 22 is transported by transport member 260, shown at the right in the drawing, through communicating path 240 to mixing path 230. The developing material in mixing path 230 is transported by transport member 270, shown at the left in the drawing, through communicating path 250 to supply path 220. All of the developing material in developing devices 120 through 150 forms a circulation travelling in the direction of arrow 300.

Developing material in supply path 220 is supplied to the exterior surface of developing sleeve 210 by the previously described transport process. The supplied developing material is maintained on the exterior surface of developing sleeve 210 by the magnets housed within said sleeve, and transported to the side confronting the photoconductive drum 101 by the rotation of the sleeve, so as to supply toner to the electrostatic latent image.

Figure 17:
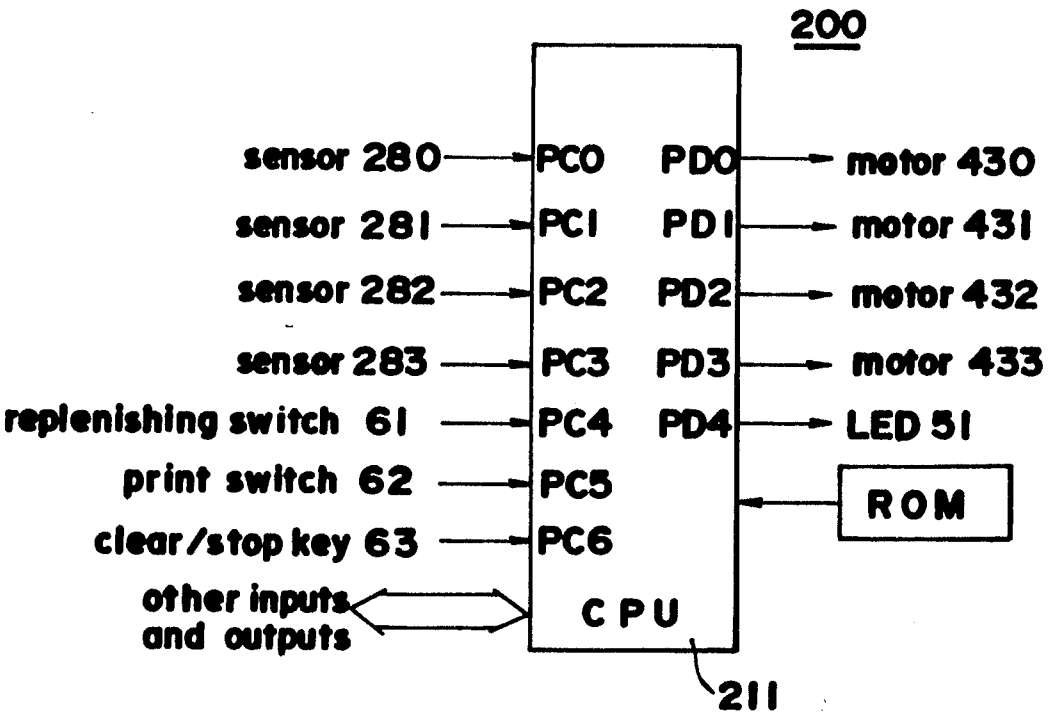

Toner density sensor 280 is provided in mixing path 230 and outputs signals at voltage levels corresponding to the toner density in the developing material to a control device (CPU, refer to FIG. 17).

Figure 16:
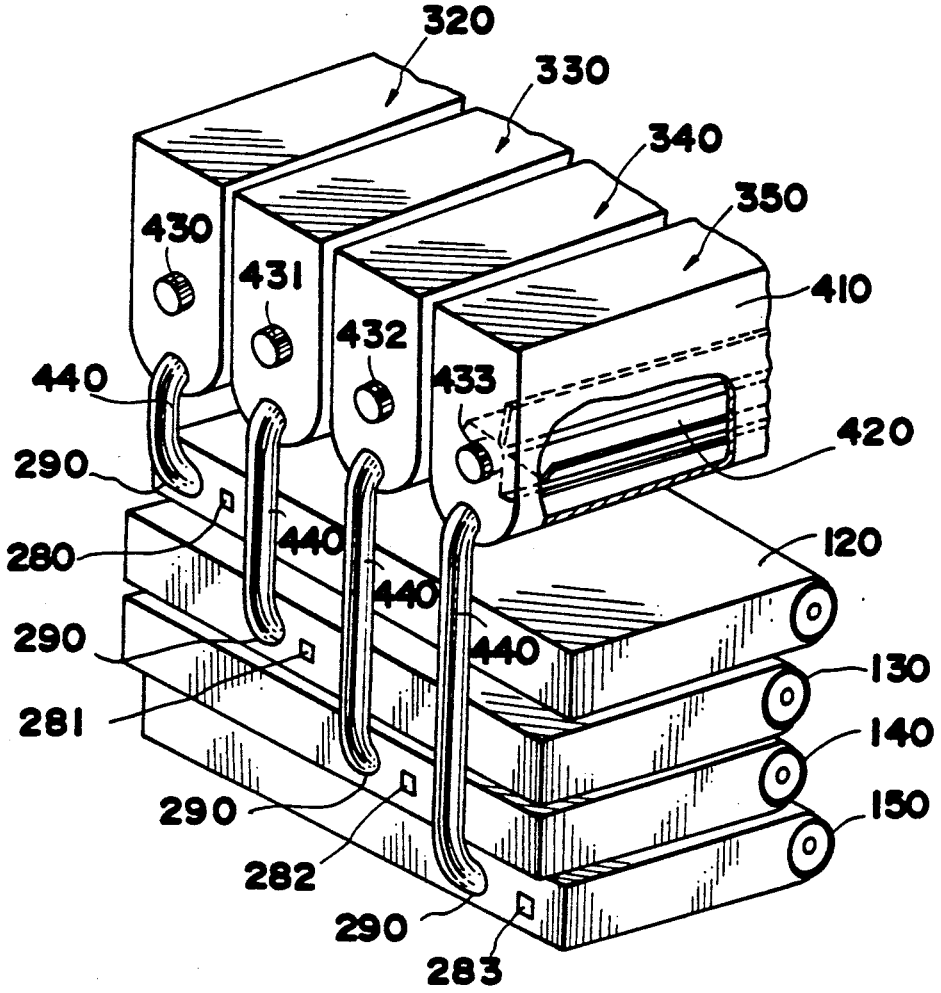

Toner replenishment port 290, shown in FIG. 16, is formed downstream from toner density sensor 280 in the transport direction, and has a toner replenishment tube attached thereto which is described later.

Toner replenishment devices 320 through 350 are identically constructed and accommodate yellow (Y), magenta (M), cian (C) and black (K) toners, respectively. Mixing vanes 420 are provided in each toner tank 410 and are rotatably driven by motors 430 through 433. One end of toner tube 440 is connected to tank 440, and the other end is connected to toner port 290 of the developing devices accommodating the corresponding color toner. Yellow (Y), magenta (M), cian (C) and black (K) toners are supplied the respective developing devices 120 through 150 based on the rotation of mixing vanes 420 rotated by the aforesaid motors 430 through 433.

Toner replenishment devices 320 through 350 are provided above the respective developing devices 120 through 150. On the other hand, developing devices 120 through 150 are arranged in multi-stage array.

(II) CONTROL CIRCUIT CONSTRUCTION

The construction of control circuit 200 of the full color copying machine of the second embodiment is described hereinafter with reference to FIG. 17. The core of control circuit 200 is CPU 211, which controls the operation of the full color copying machine by means of received signals input to the input ports and transmitted signals output from the output ports.

i. Input Ports

Input ports PC0 through PC6 are hereinafter described.

Figure 20:
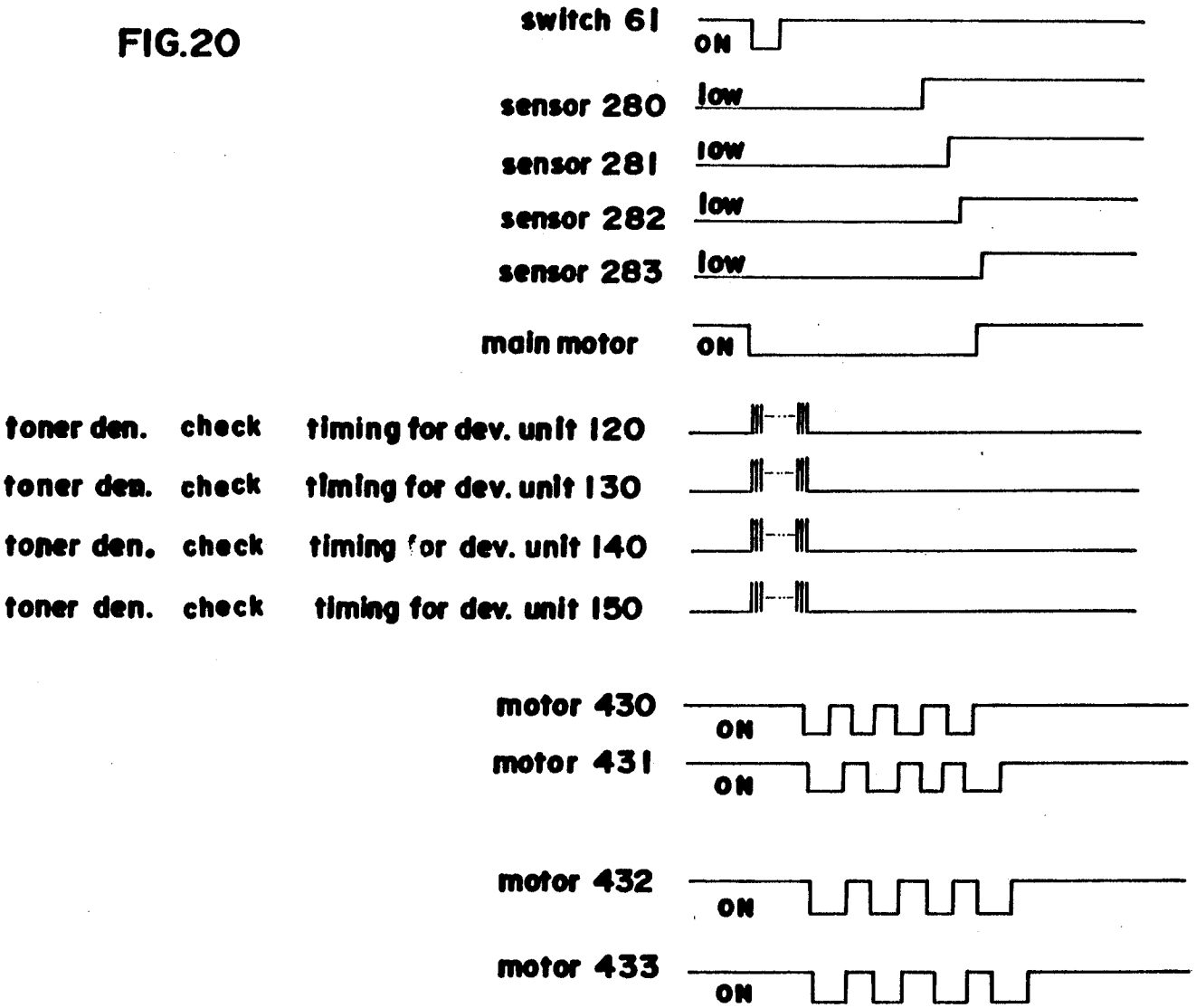
Figure 21:
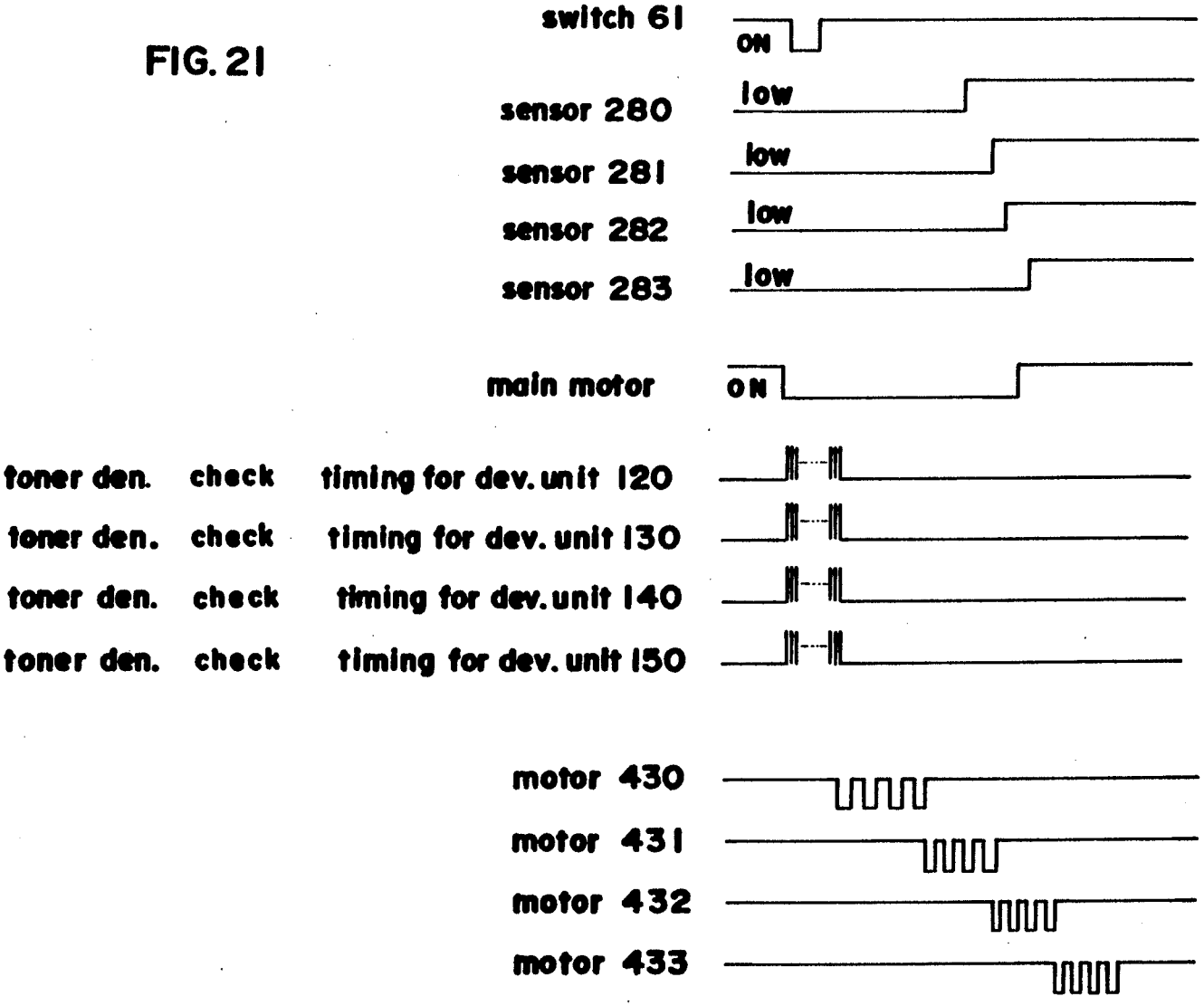
FIG. 21 is a time chart illustrating operation by a modification of the second embodiment.
Figure 22:
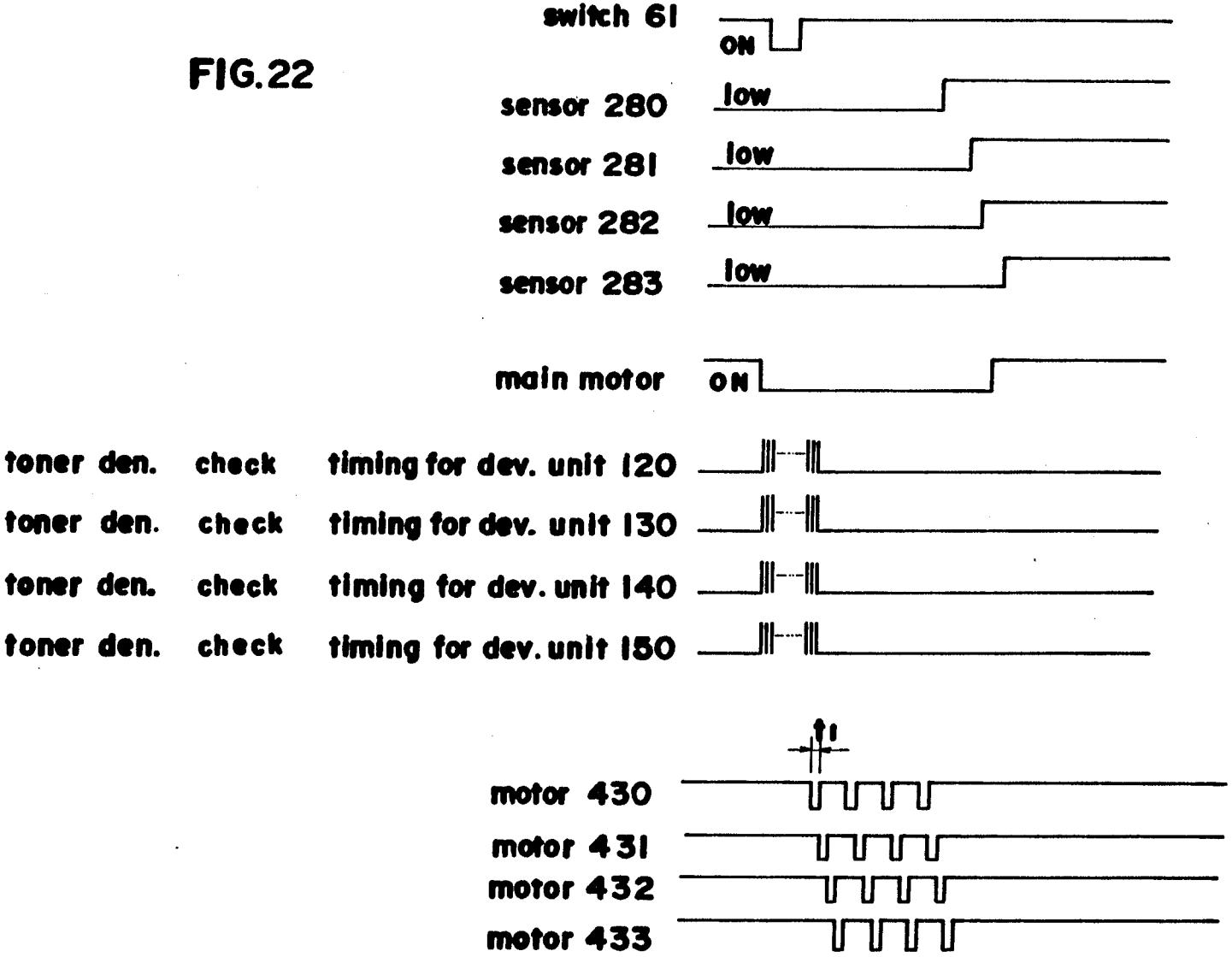
FIG. 22 is a time chart illustrating operation by a second modification of the second embodiment.

Toner density sensors 280 through 283 transmit signals to input ports PC0 through PC3, respectively. In the present embodiment, low level signals are input when toner density is less than 6% by weight (low). (FIGS. 20 through 22)

Signals are input to input port PC4 from toner replenishment switch 61 which is switched ON by the machine operator when emergency toner replenishment is desired. When switch 61 is in the ON state, input signals are low level signals.

Signals are input to input port PC5 from print switch 62 which is switched ON by the machine operator to start the copy operation. When print switch 62 is in the ON state, input signals are low level signals.

Signals are input to input port PC6 from clear-stop key 63 when key 63 is depressed by the machine operator to clear the copy conditions previously set by the operator or to stop the copy operation. When clear-stop key 63 is in the depressed state, input signals are low level signals. When emergency toner replenishment is executed by toner replenishment switch 61, the signal input to input port PB3 from clear-stop switch 63 is processed as an emergency toner replenishment stop request from the operator.

ii. Output Ports

Output ports PD0 through PD4 are hereinafter described.

Drive control signals are output from output ports PD0 through PD3 to toner replenishment motors 430 through 433. Actuation is accomplished when the output signals are low level signals (FIGS. 20 through 22).

Drive control signals are output from output port PD4 to toner replenishment display LED 51. LED 51 is lighted when the output signals are low level signals.

iii. Other

Input and output signals other than those previously mentioned (example: driven control signals for the main motor) are collectively shown as other inputs and outputs.

(III) OPERATION OF THE COPYING MACHINE OF THE SECOND EMBODIMENT

Figure 18:
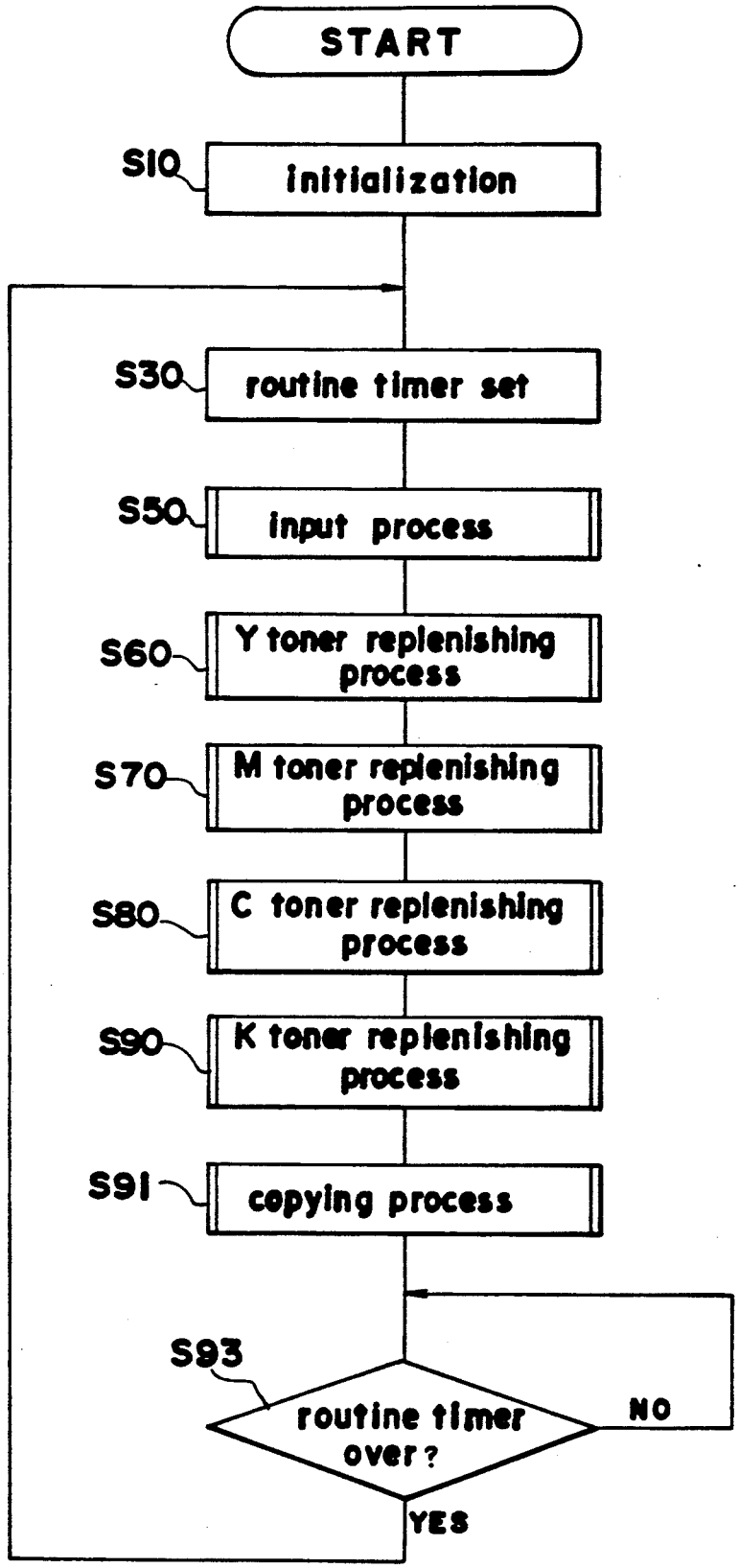

The operation of the full color copying machine relative to the processing by CPU 311 is described hereinafter.

i. Main Routine (FIG. 18)

CPU 211 starts processing when, for example, the power is switched ON and initialization is executed (step S10).

Then, in step S30, the routine timer is started, and thereafter the subroutines listed below are executed as required.

Figure 19:
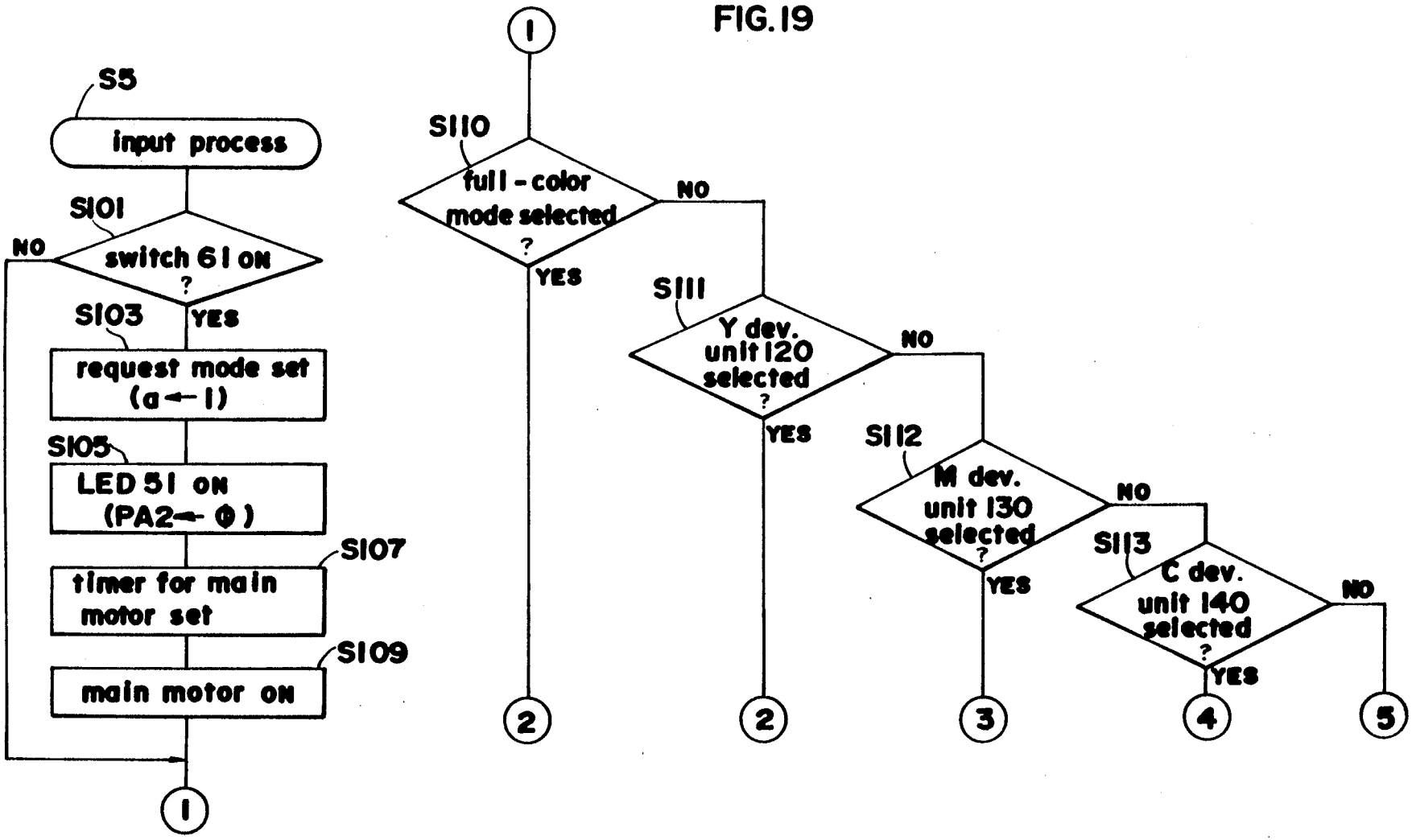

S50: input process routine (input process from replenishment switch 61, refer to FIG. 19). That is, the following routines are executed,

S60: Y toner replenishment process routine (toner replenishment process for developing device

S70: M toner replenishment process routine (replenishment process for developing device 130);

S80: C toner replenishment process routine (replenishment process for developing device 140);

S90: K toner replenishment process routine (replenishment for developing device 150).

Thereafter, the completion of the routine timer is awaited in step S93, then the routine returns to step S30, and the process is repeated.

In the toner replenishment processes (S70, S90) of the present device, toner replenishment can be accomplished by any one of three toner replenishment modes similarly to the first embodiment.

ii. Input Process (FIG. 19)

A description of the process from step S101 to S109 is identical to that shown in FIG. 4 of the first embodiment, and, therefore, is omitted herein.

In step S110, a determination is made as to whether or not the full color developing mode using all four developing devices with yellow, magenta, cian and black toner has been selected. In steps S111 through S113, the currently selected developing device is determined, based on that determination the appropriate processes 2 through 5 are executed. In processes 2 through 5, after emergency toner replenishment is accomplished for one of the developing devices 120, 130, 140 or 150, the process of selecting another developing device is executed, said selection process basically being identical to the process shown in FIG. 4, and therefore, is omitted herein. The toner replenishment processes for yellow, magenta, cian and black are substantially the same as the black and color toner replenishment processes of the first embodiment, and therefore, are also omitted herein.

In the second embodiment of the present invention, emergency toner replenishment is executed simultaneously for all four yellow, magenta, cian and black developing devices, as shown in FIG. 20, with the result that the time required for said emergency toner replenishment is minimized.

iii. First Modification of the Toner Replenishment Control in the Second Embodiment In the first modification of the second embodiment, after completion of emergency toner replenishment for one of the four yellow, magenta, cian and black developing devices, emergency toner replenishment is automatically started for a different developing device (refer to timing chart in FIG. 21).

Therefore, the time required for emergency toner replenishment is minimized, and the load on the power circuit does not become excessive because toner replenishment motors 430 through 433 are not driven simultaneously.

Further, each of the yellow, magenta, cian and black toner replenishment processes are identical to the processes described in the first modification of the first embodiment, and therefore are omitted herein.

iv. Second Modification of the Control for Toner Replenishment in the Second Embodiment In the second modification of the second embodiment, emergency toner replenishment for each of the four yellow, magenta, cian and black developing devices is executed alternately interspersed with non toner replenishment intervals (refer to FIG. 22). The non-toner replenishment intervals are pause intervals between the emergency toner replenishments executed in a total of four cycles relative to yellow, magenta, cian and black toners.

Each of the yellow, magenta, cian and black toner replenishment processes are identical to the processes of the second modification of the first embodiment, and therefore, are omitted herein.

In the second modification of the second embodiment, emergency toner replenishment for the selected developing device and emergency toner replenishment for the non-selected developing devices are executed alternately interspersed with pause intervals, and, therefore, even less time is required for emergency toner replenishment in the second modification of the second embodiment, and the load on the power circuit does not become excessive because toner replenishment motors 430 through 433 are not driven simultaneously.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus comprising:

a plurality of developing means; detecting means provided to each developing means for detecting toner density in the developing means;

selecting means for selecting at least one developing from the plurality of the developing means for development;

input means for inputting toner replenishment instructions to each developing means;

replenishing means provided to each developing means for replenishing a toner within the developing means wherein toner densities are less than a predetermined value in either a normal mode or a special mode, the replenishing means replenishing the toner during the copying operation in the normal mode and replenishing the toner in response to the input of the toner replenishment instructions in the special mode; and control means for controlling the replenishing means so as to replenish the toner to the selected developing means upon the toner replenishment in the normal mode and to replenish the toner not only to the selected developing means but also to the non-selected developing means upon the toner replenishment in the special mode.

2. An image forming apparatus as claimed in claim 1 wherein one toner replenishment operation to each developing means by the replenishing means is completed through plural cycles of toner replenishment at a specified interval.

3. An image forming apparatus as claimed in claim 1 wherein each replenishing means substantially simultaneously replenishes the toner to each developing means upon the toner replenishment in the special mode.

4. An image forming apparatus as claimed in claim 1 wherein the toner replenishment in the special mode is carried out to the selected developing means prior to the non-selected developing means.

5. An image forming apparatus as claimed in claim 1 wherein the color of the toner accommodated in each developing means is different from each other.

6. An image forming apparatus as claimed in claim 2 wherein the toner replenishment to the non-selected developing means in the special mode is carried out alternately at the interval of the toner replenishment to the selected developing means in the special mode.

7. An image forming apparatus comprising:

first and second developing units each of which has detecting means for detecting toner density in the developing unit;

selecting means for selecting one developing unit from the first and second developing units;

input means for inputting toner replenishment instructions to each of the first and second developing units;

first and second replenishing means provided respectively to the first and second developing units for replenishing the toner in either of a normal mode and a special mode to the developing units wherein toner densities are less than a predetermined value, each of the first and second replenishing means replenishing the toner during the copying operation in the normal mode and replenishing the toner in the special mode in response to the input of the toner replenishment instructions;

first control means for controlling the first and second replenishing means so as to replenish the toner in the normal mode to the selected one of the first and second developing units wherein toner density is less than the predetermined value; and second control means for controlling the first and second replenishing means so as to replenish the toner in the special mode irrespective of the selection of the developing units.

8. A toner replenishing method in an image forming apparatus having a plurality of developing units, comprising the steps of:

detecting toner density in each developing unit by detecting means provided to each developing unit;

selecting at least one of the developing units;

inputting toner replenishment instructions to the apparatus;

first toner replenishing to the selected developing units wherein toner densities are less than a predetermined value; and second toner replenishing to the developing units wherein toner densities are less than the predetermined value when the toner replenishment instructions are input.

9. An image forming apparatus comprising:

a plurality of developing means;

detecting means provided to each developing means for detecting toner density in the developing means;

input means for inputting toner replenishment instructions to each developing means;

replenishing means provided to each developing means for replenishing a toner within the developing means, the replenishing means replenishing the toner to each developing means according to the toner replenishment instructions input by the input means; and control means for controlling the replenishing means so as to replenish the toner to the developing means having toner density of less than a predetermined value when the toner replenishment instructions are input.

10. An image forming apparatus as claimed in claim 9, further comprising:

selecting means for selecting at least one developing means from the plurality of the developing means.

11. An image forming apparatus as claimed in claim 10 wherein the replenishing means replenishes the toner in the first mode to the selected developing means wherein toner densities are less than the predetermined value and replenishes the toner in the second mode to the developing means wherein toner densities are less than the predetermined value irrespective to the selection by the selecting means.

12. An image forming apparatus as claimed in claim 9 wherein the color of the toner accommodated in each developing means is different from each other.

* * * * *